US008552952B2

(12) United States Patent
Sakamaki et al.

(10) Patent No.: US 8,552,952 B2
(45) Date of Patent: Oct. 8, 2013

(54) DISPLAY DRIVE CONTROL CIRCUIT

(75) Inventors: Goro Sakamaki, Fuchu (JP); Takashi Ohyama, Tokyo (JP); Shigeru Ohta, Saitama (JP); Kei Tanabe, Kodaira (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 190 days.

(21) Appl. No.: 12/835,897

(22) Filed: Jul. 14, 2010

(65) Prior Publication Data

US 2010/0277503 A1 Nov. 4, 2010

Related U.S. Application Data

(63) Continuation of application No. 11/591,520, filed on Nov. 2, 2006, now Pat. No. 7,768,492, which is a continuation of application No. 10/323,831, filed on Dec. 20, 2002, now Pat. No. 7,176,870.

(30) Foreign Application Priority Data

Dec. 27, 2001 (JP) ..... 2001-397307

(51) Int. Cl.
*G09G 3/36* (2006.01)

(52) U.S. Cl.
USPC ..... 345/98; 345/100

(58) Field of Classification Search
USPC ..... 345/87–102, 204, 538
See application file for complete search history.

(56) References Cited

U.S. PATENT DOCUMENTS

| | | | |
|---|---|---|---|
| 4,769,713 A | 9/1988 | Yasui | |
| 5,119,083 A | 6/1992 | Fujisawa et al. | |
| 6,211,854 B1 | 4/2001 | Fujiyoshi | |
| 6,262,723 B1 | 7/2001 | Matsuzawa et al. | |
| 6,335,728 B1 | 1/2002 | Kida et al. | |
| 6,734,877 B1 | 5/2004 | Honda et al. | |
| 6,784,897 B2 * | 8/2004 | I | 345/592 |
| 6,831,617 B1 | 12/2004 | Miyauchi et al. | |
| 2002/0011998 A1 | 1/2002 | Tamura | |
| 2002/0018058 A1 | 2/2002 | Tamura | |
| 2002/0105506 A1 | 8/2002 | Hiyama et al. | |
| 2003/0038884 A1 | 2/2003 | Matsushita et al. | |
| 2003/0218682 A1 | 11/2003 | Lim et al. | |
| 2004/0202456 A1 | 10/2004 | Sasagawa | |

FOREIGN PATENT DOCUMENTS

| | | |
|---|---|---|
| JP | 63-34593 A | 2/1988 |
| JP | 02-029691 A | 1/1990 |
| JP | 05-088838 A | 4/1993 |
| JP | 08-146933 A | 6/1996 |
| JP | 08-185415 | 7/1996 |
| JP | 09-281933 A | 10/1997 |
| JP | 10-260652 A | 9/1998 |
| JP | 11-296130 A | 10/1999 |

(Continued)

*Primary Examiner* — Bipin Shalwala
*Assistant Examiner* — Steven Holton
(74) *Attorney, Agent, or Firm* — Miles & Stockbridge P.C.

(57) ABSTRACT

No flicker is displayed on the display screen during display of moving pictures and power consumption can be reduced by adding a high quality moving picture display function. Moreover, the number of times of transfer of moving pictures by comprising a still-picture•text•system•I/O bus•interface and a moving picture interface (external display interface), providing a display operation change register (DM) and a RAM access change register (RM) which are changed selectively depending on display content (display mode) displayed on a display device and displaying the display data on the display device via a picture memory even in the moving picture display mode.

10 Claims, 24 Drawing Sheets

(56) References Cited

FOREIGN PATENT DOCUMENTS

| | | | |
|---|---|---|---|
| JP | 2000-066654 | A | 3/2000 |
| JP | 2000-284766 | A | 10/2000 |
| JP | 2001-202053 | | 7/2001 |
| TW | 372308 | | 10/1999 |
| TW | 419642 | B | 1/2001 |
| WO | WO 98/02773 | | 1/1998 |

* cited by examiner

FIG. 9

| | MERIT | DEMERIT |
|---|---|---|
| ① FIG.7<br>SYSTEM INTERFACE ONLY (DISPLAY MEMORY EXISTS) | STILL PICTURE : SMALL AMOUNTS OF DATA TRANSMISSION<br>LOW POWER CONSUMPTION<br>MOVING PICTURE : SMALL AMOUNTS OF DATA TRANSMISSION<br>LOW POWER CONSUMPTION | MOVING PICTURE : FLICKER OCCURS WHEN UPDATING OR CHANGING THE SCREEN |
| ② FIG.5<br>MOVING PICTURE INTERFACE ONLY (LINE MEMORY ONLY) | MOVING PICTURE : NO FLICKER OCCURS WHEN UPDATING OR CHANGING THE SCREEN | STILL PICTURE : LARGE AMOUNTS OF DATA TRANSMISSION<br>HIGH POWER CONSUMPTION<br>MOVING PICTURE : LARGE AMOUNTS OF DATA TRANSMISSION<br>HIGH POWER CONSUMPTION |
| ③<br>INVENTION | STILL PICTURE : SMALL AMOUNTS OF DATA TRANSMISSION<br>LOW POWER CONSUMPTION<br>MOVING PICTURE : NO FLICKER OCCURS WHEN UPDATING OR CHANGING THE SCREEN<br>SMALL AMOUNTS OF DATA TRANSMISSION<br>LOW POWER CONSUMPTION | — |

VSYNC : VERTICAL SYNCHRONIZATION SIGNAL
HSYNC : HORIZONTAL SYNCHRONIZATION SIGNAL
DOTCLK : DOT CLOCK
ENABLE : DATA ENABLE SIGNAL
PD17-0 : RGB (6:6:6) DISPLAY DATA

VSYNC : VERTICAL SYNCHRONIZATION SIGNAL
HSYNC : HORIZONTAL SYNCHRONIZATION SIGNAL
DOTCLK : DOT CLOCK
ENABLE : DATA ENABLE SIGNAL
PD17-0 : RGB (6:6:6) DISPLAY DATA

DISPLAY DRIVE CONTROL CIRCUIT

CROSS-REFERENCE TO RELATED APPLICATIONS

This application is a continuation of application Ser. No. 11/591,520 filed Nov. 2, 2006 (now U.S. Pat. No. 7,768,492 issued Aug. 3, 2010), which is a continuation of application Ser. No. 10/323,831 filed Dec. 20, 2002 (now U.S. Pat. No. 7,176,870 issued Feb. 13, 2007).

BACKGROUND OF THE INVENTION

The present invention relates to a display drive control technique for controlling a picture display mode of a display device and particularly to a display drive control circuit for controlling a picture display mode of a display device for displaying still pictures and moving pictures to a liquid crystal display device, an organic EL display device and other dot matrix type display device.

In general, a dot matrix type display device is configured with a display panel including a large number of pixels arranged in a two-dimensional matrix and a display control circuit for displaying still pictures and moving pictures by supplying a picture signal to this display panel. As a display device of this type, a liquid crystal display device, an organic EL display device, a plasma display device or a field emission type display device, etc. are known. Summary of the picture display system is explained here considering, as an example thereof, a liquid crystal display device which is a typical display device and a mobile telephone using the liquid crystal display device as a display section.

Requirement for display of moving pictures on a display screen of a mobile telephone is increasing in recent years. However, since the existing mobile telephone has been mainly used to display still pictures including a text, a drive control circuit thereof is only provided with a still-picture•text•system•I/O•interface and does not comprise an interface corresponding to moving pictures. Accordingly, the existing drive control circuit is capable of displaying moving pictures but it is difficult for such circuit to display moving pictures in higher picture quality which can be seen smoothly.

FIG. 21 is a block diagram for explaining an example of a drive circuit system configuration of a mobile telephone having no interface corresponding to moving pictures which is an example of a display drive control circuit and a display device which have been once discussed by the inventors of the present invention. This display drive control circuit system 1' is configured with an audio interface (AUI) 2, a high frequency interface (HFI) 3, a picture processor 4', a liquid crystal controller driver•driver (LCD-CDR) 6' as a memory 5 and a display drive control circuit and a still-picture•text•system•I/O bus•interface (SS/IF) 7, etc. Reference numeral 9 designates a microphone (M/C); 10, a speaker (S/P); 12, an antenna (ANT); 13, a liquid crystal panel (liquid crystal display; LCD).

The picture processor 4' is configured with a baseband processor 41 including a digital signal processor (DSP) 411, an ASIC 412 and a microcomputer MPU. The audio interface (AUI) 2 controls prefetch of an audio input from the microphone 9 and output of an audio signal to the speaker 10.

For the display to the liquid crystal panel 13, picture data is read from the memory 5 and is subject to the necessary processes in the microcomputer MPU 413. Thereafter, the picture data is then written into the display RAM within the liquid crystal controller driver (LCD-CDR) 6'. In the moving picture display mode, 10 to 15 frames are changed within a second. In this system, a system I/O bus represented by the 80-system interface is used. The still-picture•text•system•I/O bus•interface (SS/IF) 7 is referred to as system interface 7 in a certain case.

Display operation in the liquid crystal controller driver (LCD-CDR) 6' is realized with a built-in clock thereof. Therefore, write operation of picture data and display operation thereof are performed asynchronously.

SUMMARY OF THE INVENTION

FIG. 22 illustrates schematic diagrams for explaining an example of display screen change operation during moving picture display in the system illustrated in FIG. 21. A profile of displaying moving pictures within the display area of the still picture is illustrated in the display screen of the mobile telephone of FIG. 22. The display profile of this figure is also applied to the subsequent figures. Write operation of picture data to the display RAM in the liquid crystal controller driver (LCD-CDR) 6' is executed without relation to the display operation. Since the write operation of picture data and read operation of the relevant data for display on the liquid crystal panel LCD are performed without any relation (asynchronously), change of display screen to the moving picture 2 of FIG. 22(*c*) from the moving picture 1 of FIG. 22(*a*) is performed in some cases from the halfway of display of the relevant picture as illustrated in FIG. 22(*b*).

In the case where a picture is changed in the course of display thereof, change of display is performed while a moving picture 1 and a moving picture 2 exist simultaneously in the same display. Therefore, interface between the moving picture 1 and moving picture 2 becomes distinctive as illustrated in FIG. 22(*b*) and this interface is visualized as flicker of display in some cases. Therefore, such interface is not preferable from the viewpoint of display quality. As described previously, it is difficult to realize high quality display only with the still-picture•text•system•I/O bus•interface SS/IF. For the display of moving pictures, it is necessary to write the picture data synchronously with the display operation.

FIG. 23 is a block diagram for describing an example of configuration of the liquid crystal controller driver and peripheral circuits thereof in the system illustrated in FIG. 21. The liquid crystal controller driver (LCD-CDR) 6' is composed of a write address generation circuit 61, a display address generation circuit 62, a display memory (M) 63 as a bit map picture memory formed of RAM, a liquid crystal drive circuit (DR) 64 and a built-in clock generation circuit (CLK) 65. The display data (DB17-0) from the baseband processor 41 of the picture processor 4' is written into the built-in display memory M from the system interface (SS/IF) 7.

In this case, a write address is generated in the write address generation circuit (SAG) 61 with each signal of system interface signal CS (chip select) and signal RS (resister select) and signal WR (write). The display data in the display operation is read from the display memory (M) 63 depending on the display address generated by the display address generation circuit (DAG). This display address is generated in synchronization with the clock generated by the built-in clock generation circuit (CLK) 65. Operation by this built-in clock and operation by the system interface (SS/IF) are performed without any relation (asynchronously).

FIG. 24 is a schematic diagram for describing a profile of change of display of moving picture on the display screen of a mobile telephone utilizing the liquid crystal controller driver of the system illustrated in FIG. 23. A display read line by the display operation (scanning line: pixel selection line)

LR is read sequentially from the beginning at a constant rate depending on the built-in clock. Write operation to the memory M of display data from the system interface (SS/IF) 7 is performed without any relation from the display operation. Therefore, the write line LW by the system interface (SS/IF) 7 sometimes goes ahead of the display read line LR by the display operation. Namely, the display write line LW and display read line LR sometimes cross with each other.

When the write line and read line cross with each other as illustrated in FIG. 24(*c*), flicker is generated in the display at these crossing lines when the moving picture display condition of (a) changes to that of (b). In the display of 60 frames per second, when the 15 frames of moving picture are displayed per second, change of display is required once for every four frames. In this case, four changes of display occur in every second and flickers can be observed for times in every second. Such flickers of display has yet been left as a problem to be solved in the display device of this type.

When a configuration to eliminate such flicker of display described above is additionally provided to the liquid crystal controller driver, power consumption of a display device increases and this large power consumption is not preferable particularly for a mobile terminals such as a mobile telephone. It is therefore an object of the present invention to provide a display drive control system which has realized low power consumption by controlling power consumption of the additionally provided moving picture display function which has eliminated flicker of display and ensures high display quality during display of moving pictures.

The present invention introduces, in order to attain the object described above, an interface corresponding to moving pictures which is referred to as a first function in addition to a system interface in the still picture mode which is referred to as a second function and is characterized in realization of low power consumption by changing to a still picture interface (system interface) for operation of interface corresponding to moving pictures only during the required period. A configuration of the display drive control circuit of the present invention can be summarized as follows.

(1) A still-picture•text•system•I/O bus•interface, an external display interface for inputting moving picture data from a moving picture data processor, a picture display memory having a picture data storing area of at least one frame, and a display drive circuit for supplying display data to a display device are provided.

(2) A display operating changing register for selectively connecting display data of the still-picture•text•system•I/O bus•interface and external display interface for write and read operations and a memory access changing register are also provided in the item (1).

(3) In the item (1), a vertical synchronization signal input terminal of moving picture is also provided to control the write and read timings of moving picture display data to the picture display memory with a vertical synchronization signal inputted from the vertical synchronization signal input terminal.

(4) In the items (1) to (3), an enable signal input terminal is also provided for designating an area for displaying moving pictures to the display screen of the display device.

(5) In the items (1) to (3), an enable signal input terminal is also provided for designating an area for updating a part of the still picture in the area for displaying moving picture of the display screen of the display device.

(6) A first port to which moving picture data is transferred and a second port to which still picture data is transferred are provided.

(7) A memory for storing moving picture data to be supplied to the display panel, a first port to which moving picture data is transferred as the picture data stored in the memory, and a second port to which still picture data is transferred as the picture data stored in the memory are provided.

(8) The memory for storing picture data to be supplied to the display screen of the display panel, the first port to which moving picture data is transferred as the picture data stored in the memory and the external signal terminal to which a signal indicating the beginning of display picture is supplied are provided and transfer of the moving picture data is started in synchronization with the signal supplied to the external terminal.

(9) In the item (8), the second port to which the still picture data is transferred as the picture data stored in the memory is further provided.

(10) The memory for storing picture data to be supplied to the display screen of the display panel, the port to which the moving picture data is transferred as the picture data stored in the memory and the external terminal for receiving a signal to write the moving picture data to the predetermined area of the memory are provided.

(11) The memory for storing picture data to be supplied to the display panel, the first port to which the moving picture data is transferred as the picture data stored in the memory, the second port to which the still picture data is transferred as the picture data stored in the memory and a first control register for designating any one of the moving picture data supplied to the first port and the still picture data supplied to the second port at the time of writing the picture data to the memory are provided.

(12) A clock generation circuit for generating an internal operation clock, the memory for storing the picture data to be supplied to the display panel, the first port to which the moving picture data is transferred, as the picture data stored in the memory, in synchronization with a synchronization signal, the second port to which the still picture data is transferred as the picture data stored in the memory, and the first control register for controlling read operation of picture data transferred from the memory are provided;

the still picture data supplied to the second port can be written into the memory in synchronization with the internal operation clock; and the first control register designates any one of the read operation synchronized with the synchronization signal and read operation synchronized with the internal clock signal at the time of reading the picture data from the memory.

According to the display drive control circuit of the present invention configured as described above, moving pictures may be displayed in higher picture quality and low power consumption can also be realized by changing the moving picture interface and still picture interface depending on contents of display (moving picture mode/still picture mode).

BRIEF DESCRIPTION OF THE DRAWINGS

FIG. 9 is a diagram for describing merit and demerit of the configuration of the present invention through comparison of the configurations of FIG. 7 and FIG. 5.

DETAILED DESCRIPTION OF THE PREFERRED EMBODIMENTS

Figure 1:
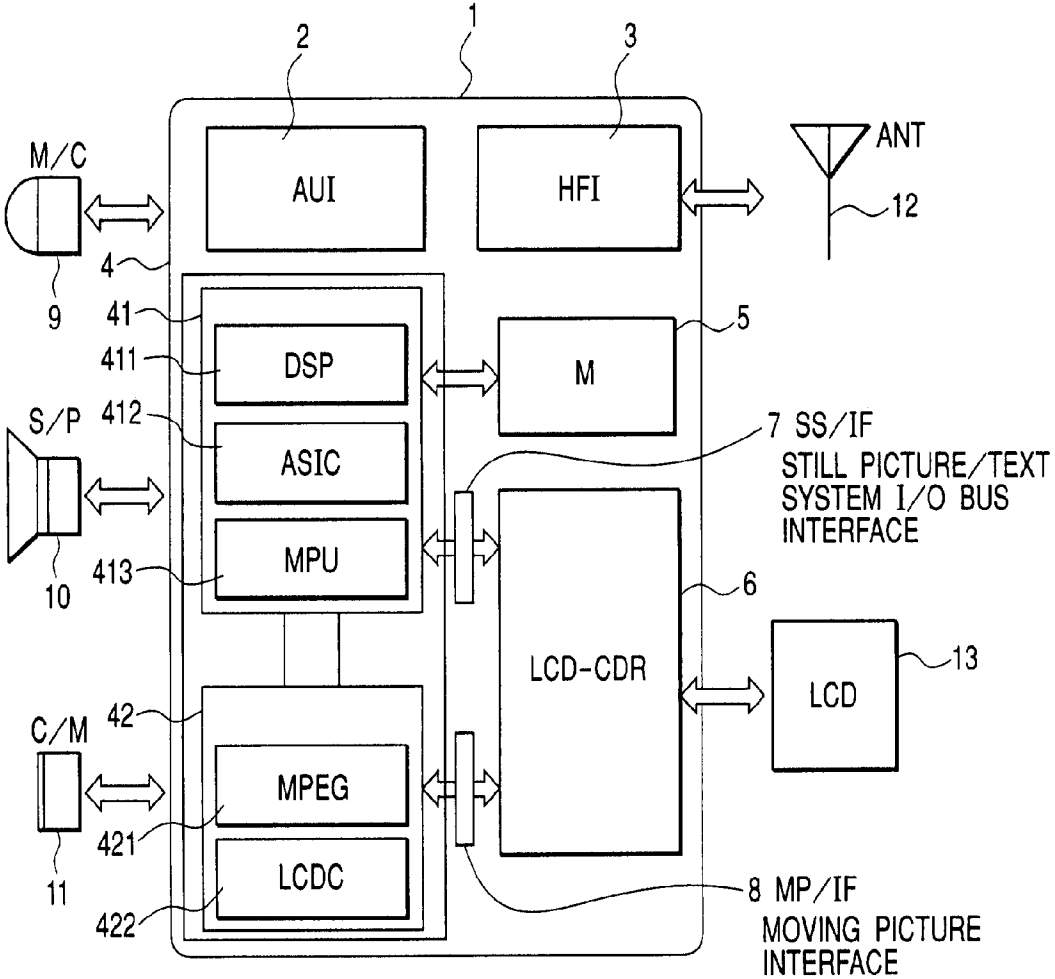
FIG. 1 is a diagram for describing a total configuration of an embodiment of the present invention.

The preferred embodiments of the present invention will be described in detail with reference to the accompanying drawings thereof. FIG. 1 is a diagram for describing the entire configuration of an embodiment of the present invention and a block diagram for explaining an embodiment of a drive circuit system configuration of a mobile telephone including a moving picture interface (namely, including a first port to which moving picture data is transferred) referred to as a first function as an example of the display drive control circuit of the present invention. This display drive control circuit 1 is composed of an audio interface (AUI) 2 similar to that of FIG. 20, a high frequency interface (HFI) 3, a picture processor 4 as a picture data processor, a memory 5 as a picture display memory, a liquid crystal controller driver 6 (LCD-CDR) as a display drive control circuit, a still-picture•text•system•I/O bus•interface (SS/IF) 7 as a second function (namely, including a second port to which the still picture data is transferred).

The memory 5 is a frame memory (bit map memory) for storing the display data as many as at least one frame of picture. This memory is hereinafter referred to as a graphic RAM. Moreover, in the description of the embodiments, the still-picture•text•system•I/O bus•interface (SS/IF) 7 is sometimes described as a system interface 7 or moving picture interface.

The picture processor 4 is provided with an application processor (APP) 42 including a moving picture processor (MPEG) 421 and a liquid crystal display controller (LCDC) 422 in addition to a baseband processor 41 including a digital signal processor (DSP) 411, ASIC 412 and a microcomputer MPU. Reference numeral 9 designates a microphone (M/C9); 10, a speaker (S/P); 11, a video camera (C/M); 12, an antenna (ANT); 13, a liquid crystal panel (liquid crystal display; LCD). The ASIC 412 also includes peripheral circuit functions which are required for the other mobile telephone system configuration. Moreover, the picture processor 4 may be formed on single semiconductor substrate (chip) like a single crystalline silicon or the baseband processor 41 and application processor 42 may respectively be formed on single semiconductor substrate (chip).

Figure 21:
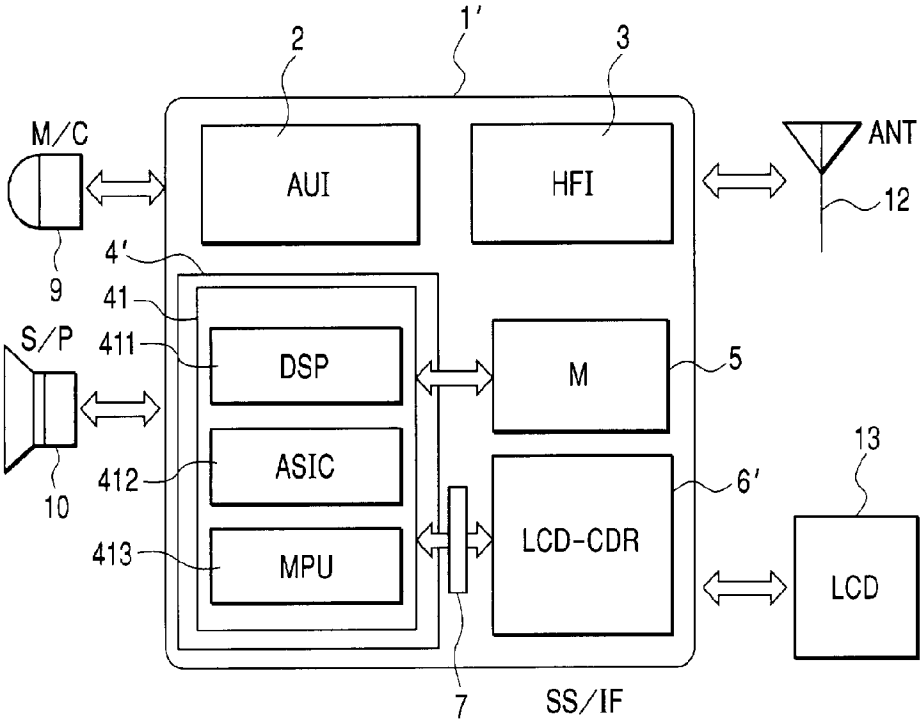
BACKGROUND ART FIG. 21
FIG. 21 is a block diagram for describing an example of a system configuration of a drive control circuit of a mobile telephone including no moving picture interface as an example of the display drive control circuit which has been discussed by the inventors of the present invention before application of the present invention.
Figure 22:
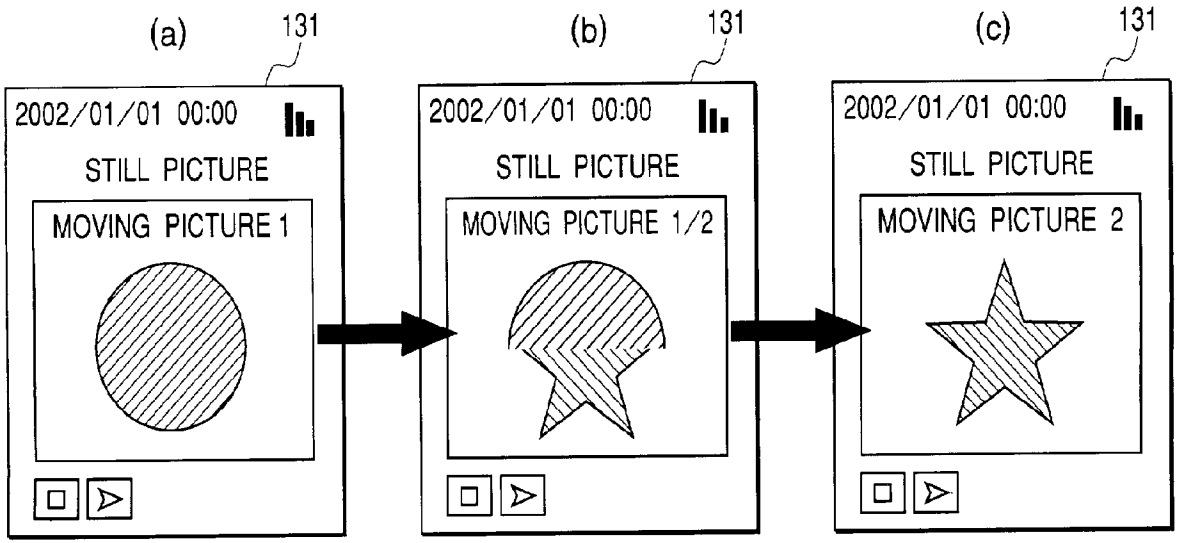
BACKGROUND ART FIG. 22
FIG. 22 is a schematic diagram for describing an change operation example at the time of displaying moving pictures in the system configuration of FIG. 21.

A baseband processor BBP which is provided in general in the mobile telephone system illustrated in FIG. 21 is insufficient in its moving picture processing capability. In addition to this baseband processor BBP, an sub-MPU referred to as an application processor (APP) is also known. The application processor (APP) 42 of FIG. 1 also comprises a built-in MPEG processor (MPRG) 421 for the MPEG moving picture process. In addition, the application processor (APP) 42 transfers picture data to the liquid crystal controller driver (LCD-CDR) 6 with the moving picture interface (MP/IF) 8. Still picture display data and text display data are transferred to the liquid crystal controller driver (LCD-CDR) 6 via the system interface (SS/IF) 7 like the system of FIG. 21.

Figure 2:
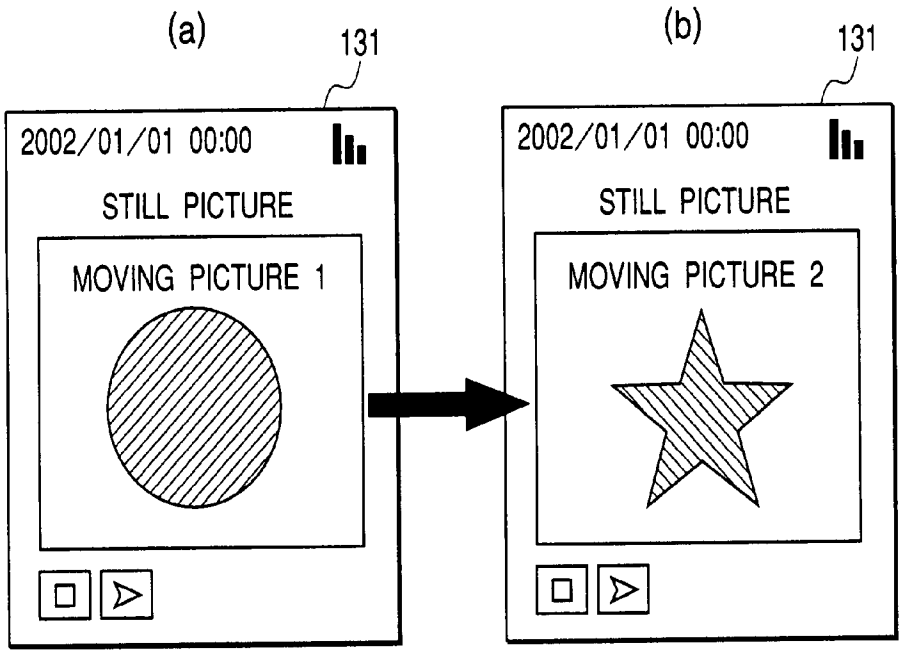
FIG. 2 is a schematic diagram for describing a profile of change of display of a moving picture on the display screen of a mobile telephone utilizing the configuration of an embodiment of the display drive control circuit of the present invention.

FIG. 2 is a schematic diagram for describing a profile of change of display of moving picture on the display screen of a mobile telephone utilizing an embodiment of the display drive control circuit of the present invention. The moving picture interface MP/IF 8 executes display operation with synchronization signals (vertical synchronization signal VSYNC, horizontal synchronization signal HSYNC, dot clock DOTCLK) which are required for display operation and writes the display data into the display memory (built-in RAM: M) 63 of the liquid crystal controller driver (LCD-CDR) 6 with a display data signal (for example, 18-bit: PD17 to PD0, hereinafter referred to as PD17-0) and a data enable signal (ENABLE) which will be described later. Thereby, change of display screen to the display of FIG. 2(*b*) from the display of FIG. 2(*a*) is performed from the beginning of the relevant display and changing from the intermediate part of display is never occurs.

Figure 3:
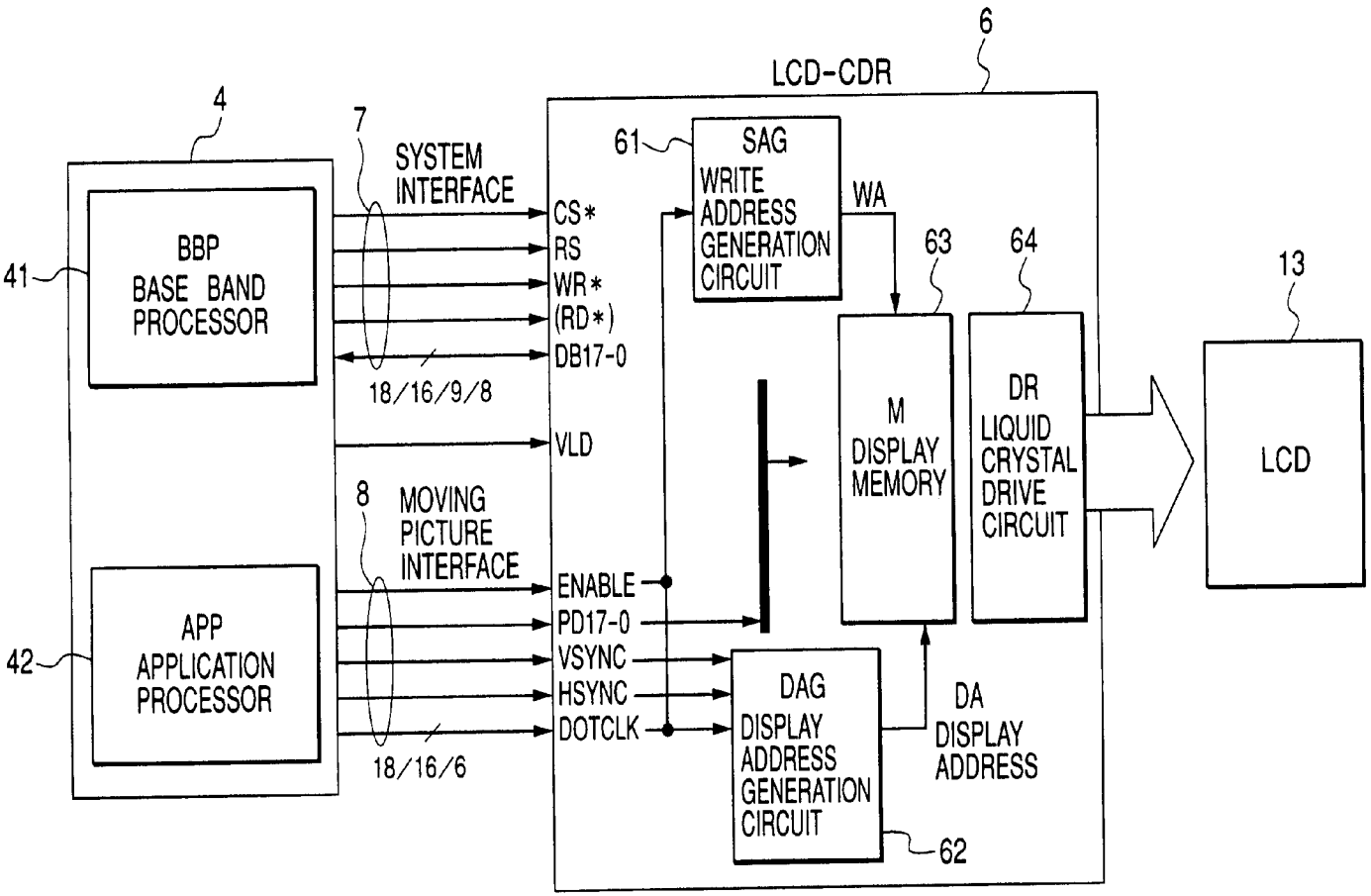
FIG. 3 is a block diagram for describing circuit configuration of a liquid crystal controller driver of the present invention and the related circuits thereof.

FIG. 3 is a block diagram for describing moving picture display operation with the moving picture interface through the circuit configuration of the liquid crystal controller driver and the related circuits thereof of the present invention. In FIG. 3, the like elements having the like functions as those in FIG. 1 are designated with like reference numerals. The liquid controller driver (LCD-CDR) 6 is formed, for example, with the known CMOS manufacturing process on a semiconductor substrate (chip) like a single crystalline silicon with inclusion of a write address generation circuit (SAG) 61, a display address generation circuit (DAG) 62, a display memory (M) 63 and a liquid crystal drive circuit (DR) 64. The display data is written from the data bus (PD17-0). In this case, the write address WA is generated by the write address generation circuit (SAG) 6 based on the dot clock DOTCLK and enable signal ENABLE among the moving picture interface signals (VSYNC, HSYNC, DOTCLK, ENABLE). Namely, the address generation circuit (SAG) 61 includes a counter which counts the dot clock DOTCLK in accordance with active level of the enable signal ENABLE and an output of this counter is defined as the write address WA. This enable signal ENABLE is set to the active level at the beginning of the moving picture display area and is also set to the non-active level at the ending of the moving picture display area. The counter of the write address generation circuit 61 is reset in its count value with the active level of enable signal and starts the count operation of the dot clock DOTCLK. When the moving picture display area is displayed at the center of the display panel as illustrated in FIG. 2, a register for storing the start address and the end address of the area corresponding to the moving picture display area of the display memory is provided in the liquid crystal controller driver 6. In this case, an output of the counter in the write address generation circuit 61 is defined as the write address with addition of the start address.

Display data is read from the built-in memory (M) 63 depending on the display address generated from the display address generation circuit (DAG) 62 based on the moving picture interface signal and is then transferred to the liquid crystal drive circuit (DR) 64. The display address generation circuit 62 is initialized with the active level of the VYNC and HSYN signals and also includes a counter for counting the dot clock DOTCLK. An output of this counter is defined as the display address DA. Namely, both the write address WA and read address DA of display data are generated with reference to the moving picture interface signal.

Figure 4:
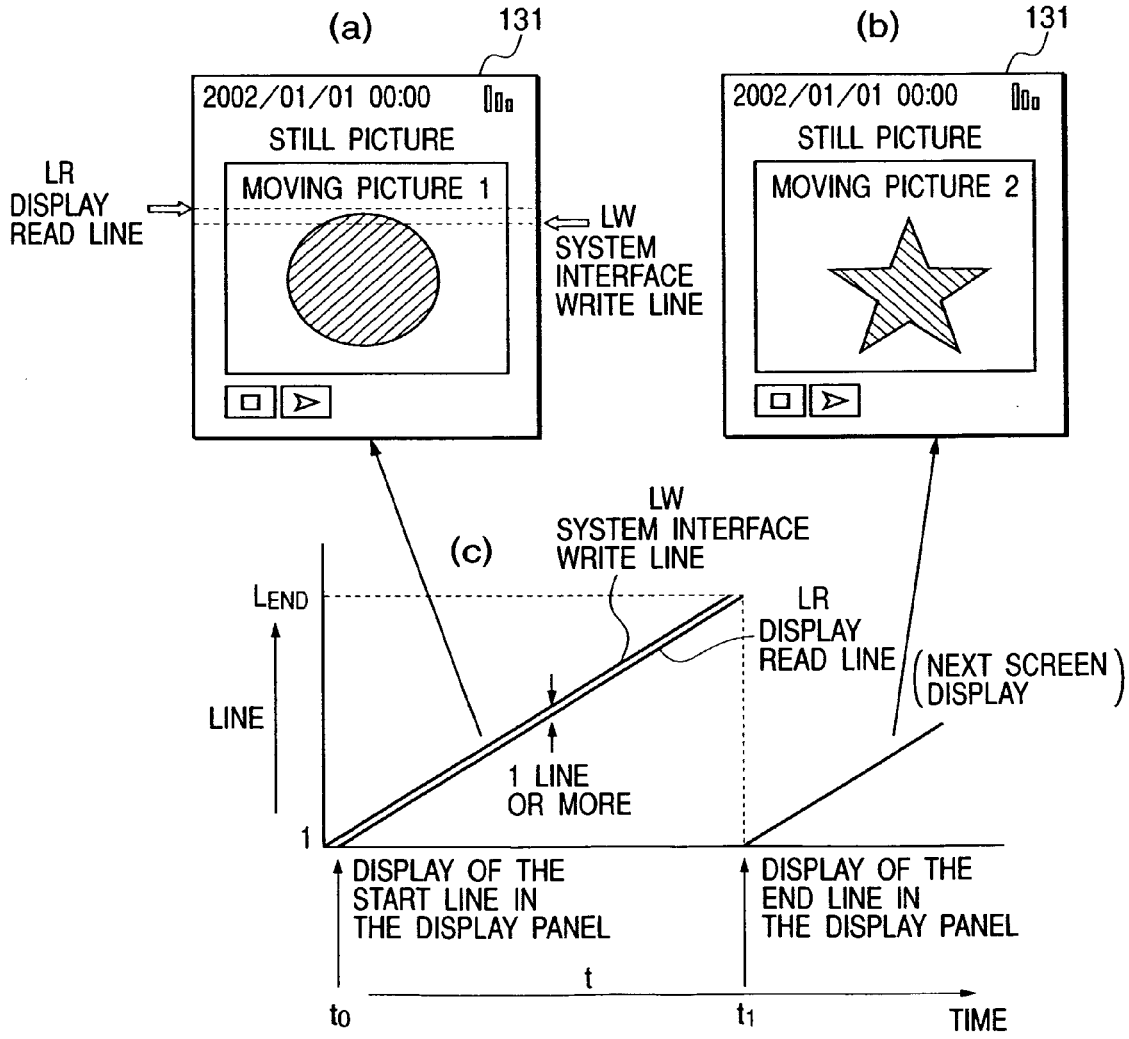
FIG. 4 is a schematic diagram for describing, as display operation in the moving picture interface, a profile of change of display of the moving picture on the display screen of the mobile telephone utilizing a configuration of an embodiment of the display drive control circuit of the present invention.

FIG. 4 is a schematic diagram for describing, as a display operation at the moving picture interface, a profile of change of display of the moving picture on the display screen of the mobile telephone utilizing an embodiment of the display drive control system of the present invention. The display data from the system interface (SS/IF) 7 is written to the display memory (M) 63 depending on the dot clock DOTCLK and enable signal ENABLE from the moving picture interface (MP/IF) 8 of FIG. 3.

The display data is read in accordance with the moving picture interface signals (VYNC, HSYNC, DOTCLK). The write and read operations of picture data are activated with reference to the same signal and therefore executed in the constant rate. LR in FIG. 4(*a*) is the read line of display data, while LW is the write line of display data. Moreover, $L_{END}$ of FIG. 4(*c*) is the end line.

Figure 23:
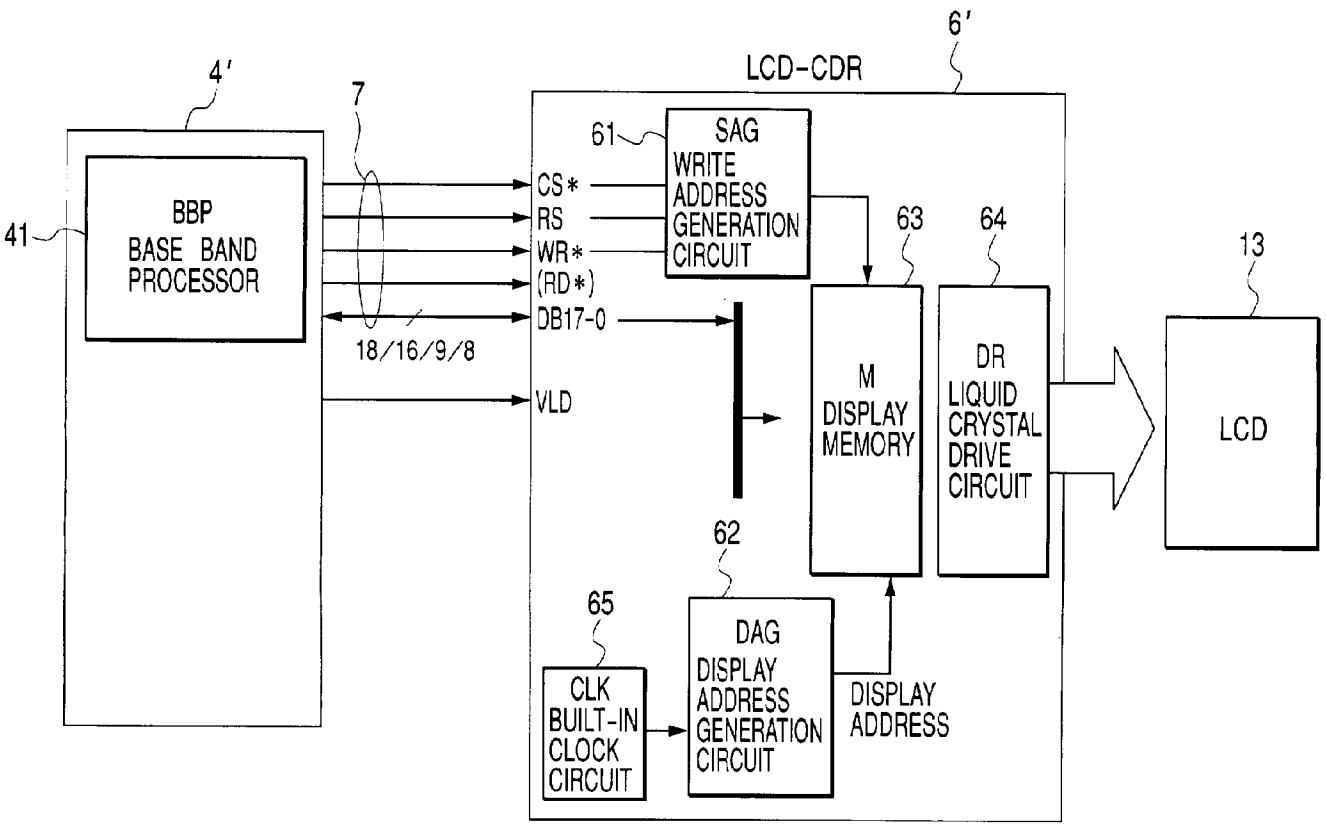
BACKGROUND ART FIG. 23
FIG. 23 is a block diagram for describing a configuration example of the liquid crystal controller driver and peripheral circuits thereof in the system configuration of FIG. 21.
Figure 24:
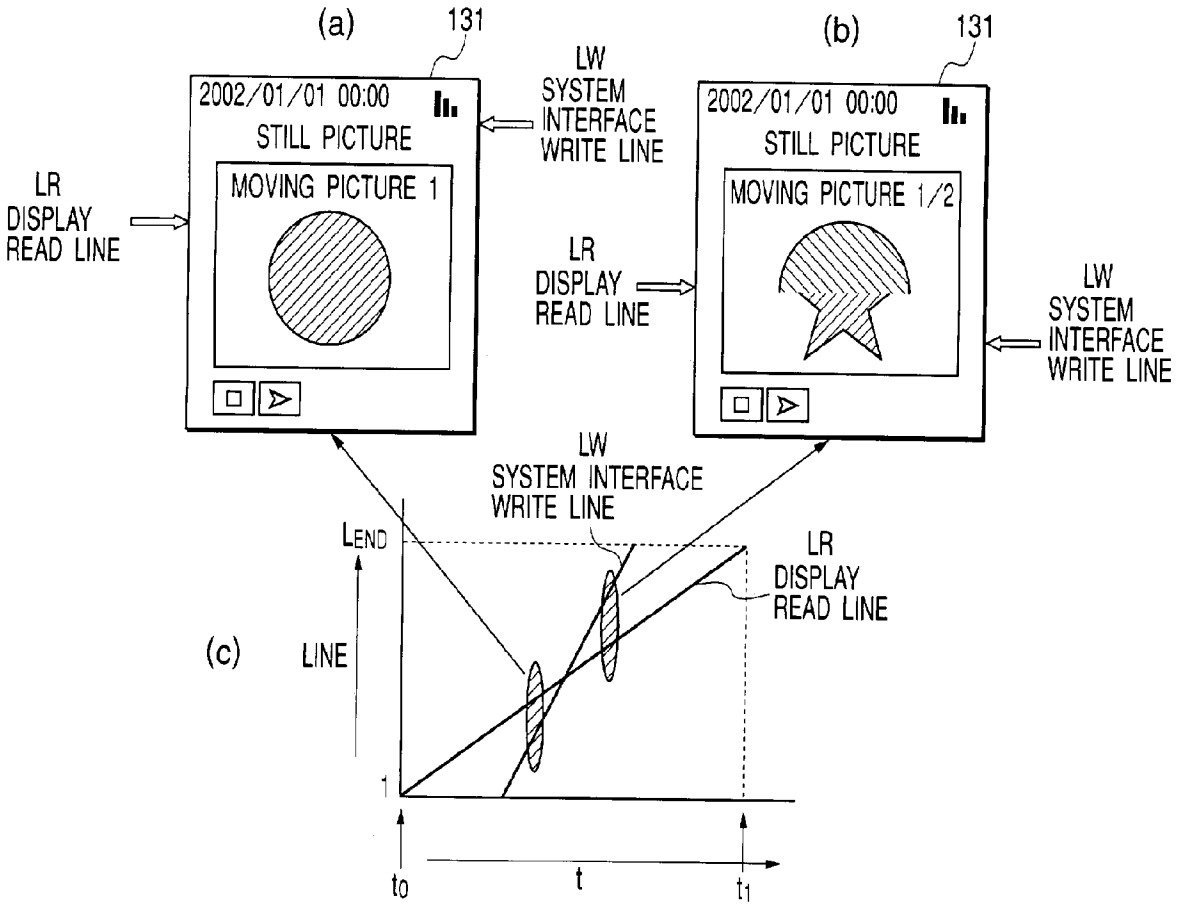
BACKGROUND ART FIG. 24
FIG. 24 is a schematic diagram for describing a profile of change of display of moving picture on the display screen of a mobile telephone utilizing the liquid crystal controller driver in the system configuration of FIG. 23.

The time $t_0$ means the screen start line display time and the time $t_1$ means the screen end line display start time. Therefore, since the write operation of display data does not go ahead the read operation thereof with each other, there is no boundary between the moving picture 1 and moving picture 2 as described with reference to FIG. 23 and flicker is not generated in the display screen. It is always enough when an interval of one line or more is kept between the write address and read address. In FIG. 4, the write operation to the display memory and read operation therefrom seem to be generated simultaneously in the same time, but actually it is requested to understand that the write operation is executed in the former half cycle of one operation cycle, while the read operation is executed in the latter half cycle thereof. However, in the case where the display memory 63 is a two-port memory provided with the write port and read port, this memory can simultaneously execute both write operation and read operation.

Figure 5:
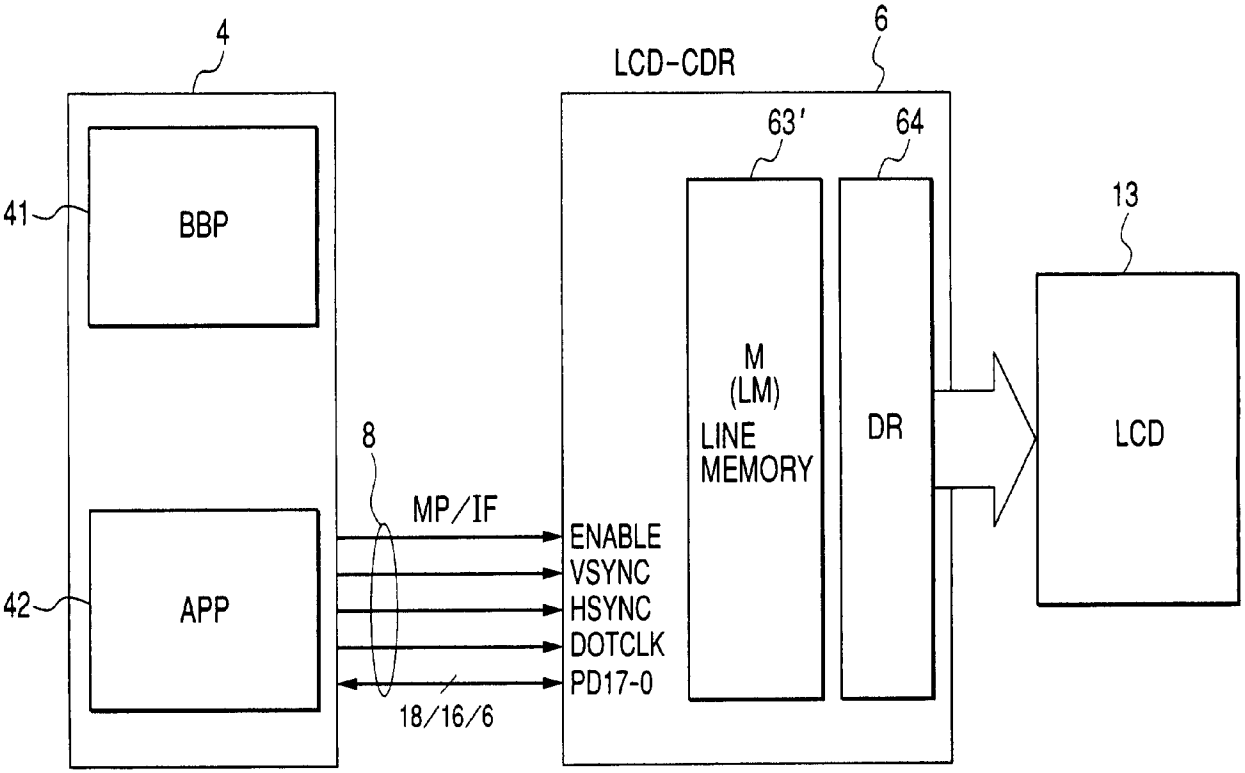
FIG. 5 is a diagram for describing a moving picture interface, a configuration of the liquid crystal controller driver not including a built-in memory and operations thereof for describing effects of the embodiment of the present invention through comparison
Figure 6:
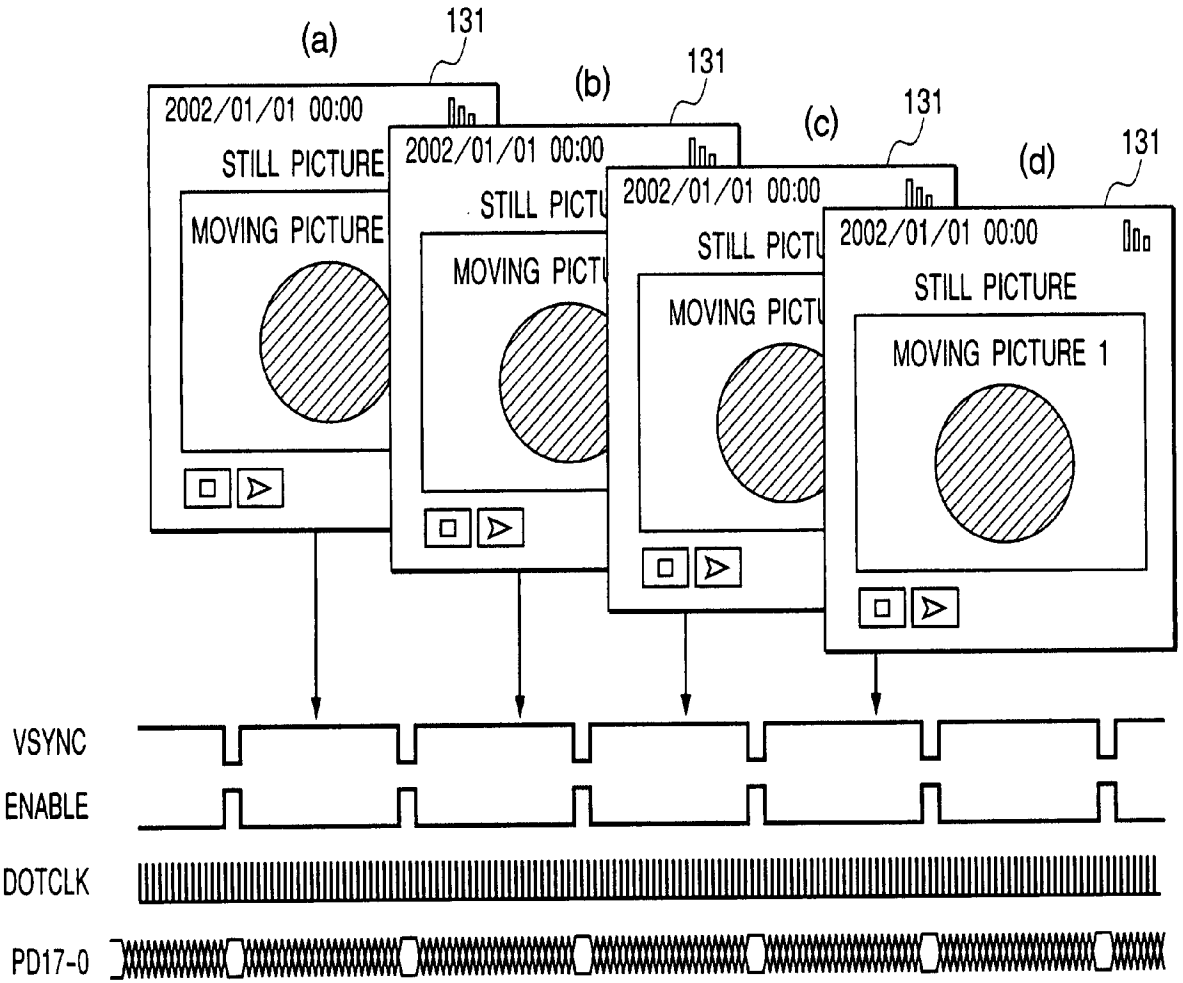
FIG. 6 is a schematic diagram for describing a profile of still picture display by the liquid crystal controller driver of FIG. 5.

Next, the still picture display mode will be explained. FIG. 5 is a diagram for describing the configurations of the moving picture interface and liquid crystal controller driver not including a built-in memory and operations thereof through comparison of effects of the embodiment of the present invention. Moreover, FIG. 6 is a schematic diagram for describing a profile of the still picture display by the liquid controller driver of FIG. 5. This liquid crystal controller driver (LCD-CDR) 6 includes a line memory (LM) 63' as the memory M.

In this configuration, since a RAM memory such as bit map memory is not provided, the same data must always be transferred continuously to the liquid crystal controller driver (LCD-CDR) 6 as illustrated in FIGS. 6(*a*), 6(*b*), . . . even in the still picture display mode. Therefore, electrical power is also required for data transfer and reduction of power consumption is very difficult. In addition, since the transfer data is difference for every display screen in the moving picture display, the circuit of the present invention (refer to FIG. 3) which assures the write operation in synchronization with the display operation is very effective.

Figure 7:
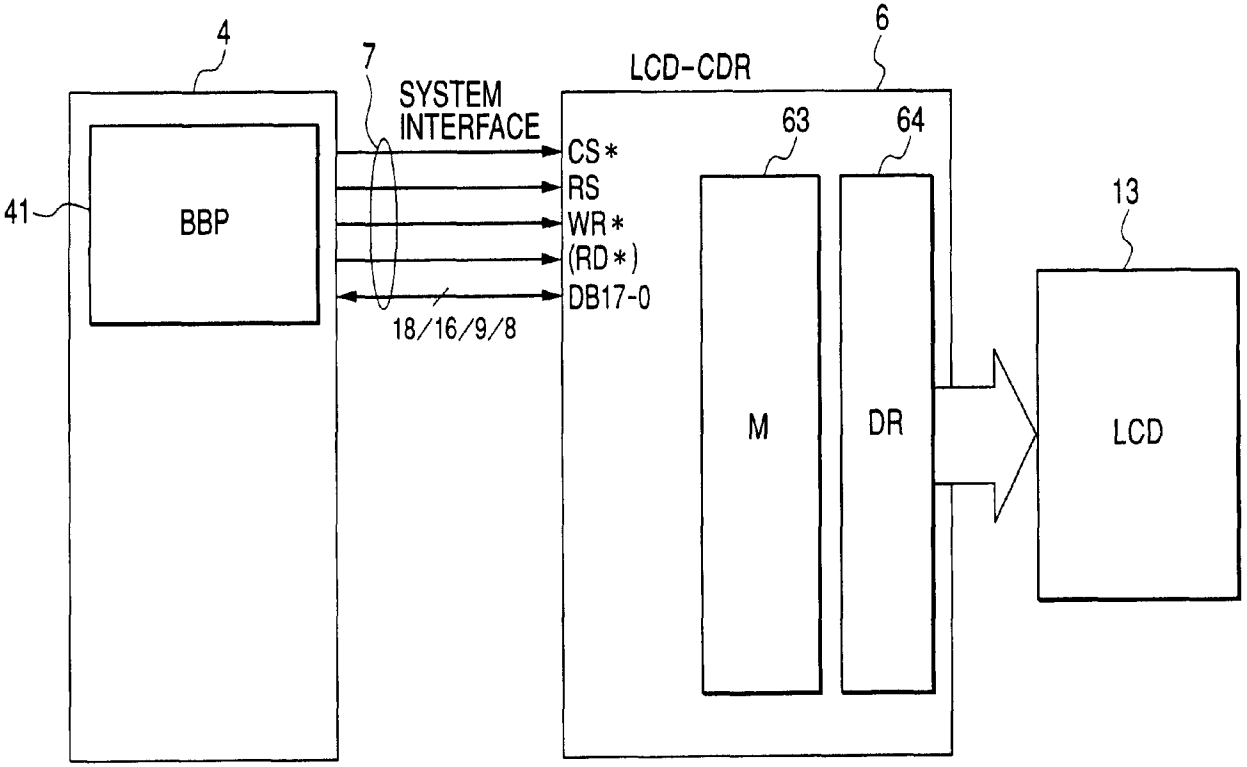
FIG. 7 is a diagram for describing the system interface, a configuration of the liquid controller driver for data transfer with a built-in memory and operation thereof for describing effects of the embodiment of the present invention through comparison.
Figure 8:
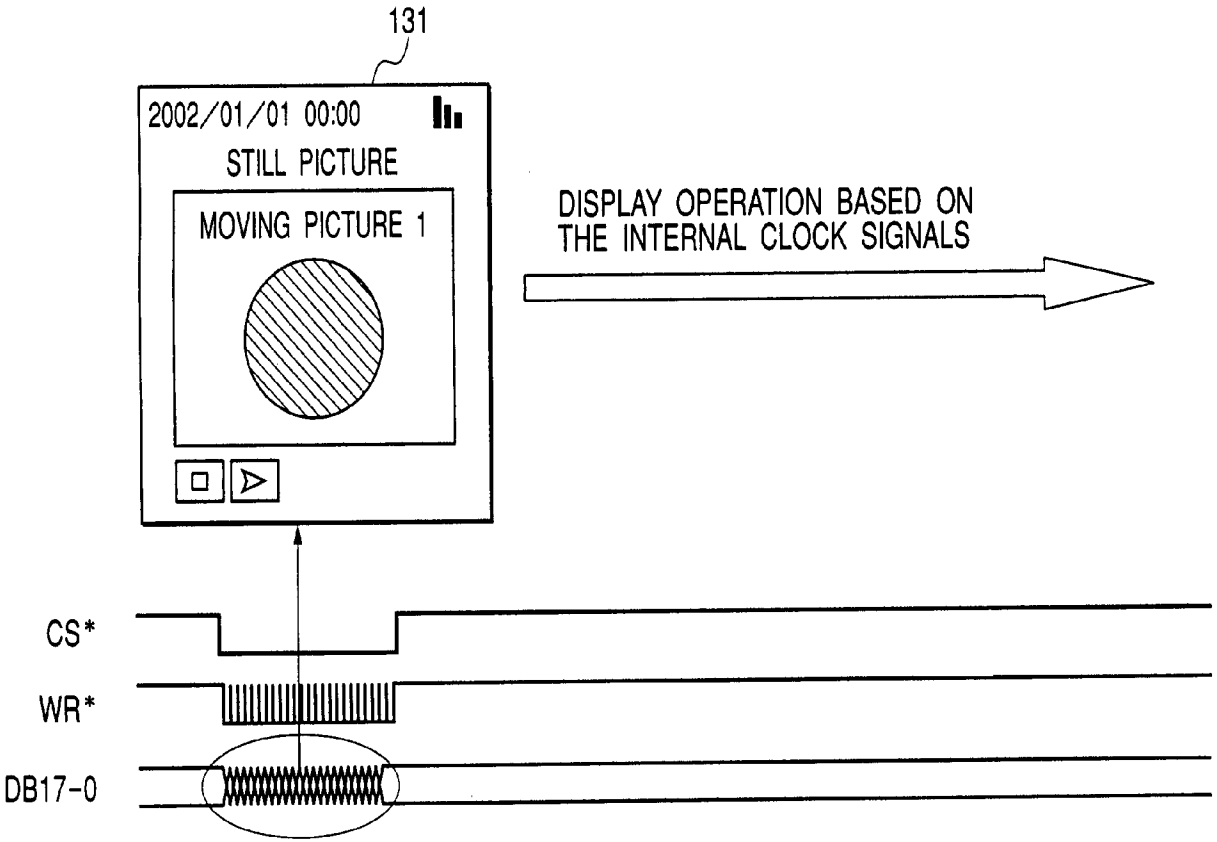
FIG. 8 is a schematic diagram for describing a profile of still picture display by the liquid crystal controller driver of FIG. 7.

FIG. 7 is a diagram for describing a configuration and operation of the system interface and liquid crystal controller driver for data transfer by the built-in memory through comparison of effects of the embodiment of the present invention. Moreover, FIG. 8 is a schematic diagram for describing a profile of the still picture display by the liquid crystal controller driver of FIG. 7. In the configuration illustrated in FIG. 7, as the built-in memory (M) 63, a bit map memory (M) 63 which is the RAM memory like that of FIG. 3 is built in as the display memory.

After the picture data of a display screen is once written to this built-in memory (M) 63 after illustrated in FIG. 8, it is no longer required to transfer again the still picture data to read the data in the memory (M) 63 with the built-in clock. Therefore, power consumption caused by the data transfer can be reduced. The embodiment of the present invention utilizes the configuration of FIG. 7 in the still picture display mode on the basis of this concept in order to implement functions of the configuration of FIG. 5 in the moving picture display mode. For the changing between the still picture display mode and moving picture display mode, a register described later is provided and these display modes are changed depending on the conditions of this register.

FIG. 9 is a diagram for describing merit and demerit of the configuration of the present invention through comparison of the configurations of FIG. 5 and FIG. 7. In the configuration ① of FIG. 9 where only the system interface with a display memory (RAM) is provided, amount of transmission of display data can be minimized even in any picture display mode of the still picture display mode and moving picture display mode because the display memory (RAM) is built in. However, flicker is generated in the display screen as described in regard to FIG. 20 to FIG. 23.

In the configuration ② of FIG. 9 where only the moving picture interface with a line memory is provided, picture display without any flicker is possible but power consumption increases because data transfer is always required with inclusion of the still picture display and therefore realization of low power consumption is difficult. Meanwhile, according to the configuration of the embodiment of the present invention, namely the configuration ③ of FIG. 9 where the built-in memory and moving picture interface are provided and moreover the still picture display mode and moving picture display mode are changed, change of display of moving picture without any flicker in the display picture is possible and moreover low power consumption can be realized with minimum necessary data transfer.

Next, a practical system configuration and operation thereof to realize the changing of the display modes of the moving picture and still picture in the moving picture interface and system interface by the present invention will be explained.

Figure 10:
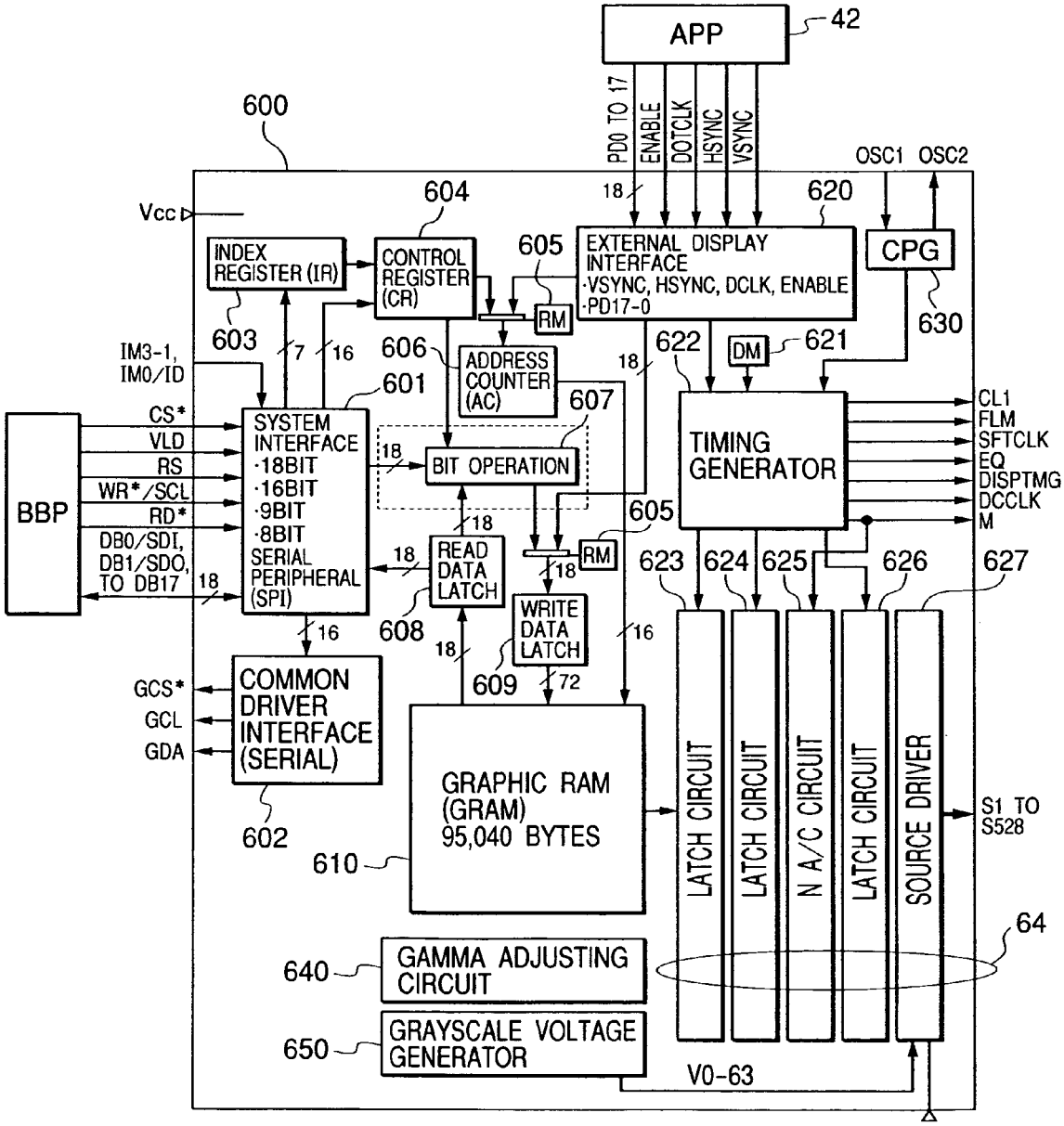
FIG. 10 is a diagram for describing a circuit configuration of a driver chip embodying the liquid crystal controller driver of the present invention.

FIG. 10 is a diagram for describing a circuit configuration of a driver chip embodying a liquid crystal controller driver which forms the display drive control circuit of the present invention. Still picture data and text data or the like to this driver chip 60 are written into a system interface 601 from a baseband processor 41 and these data are written as the display data to a memory of the address designated by an internal address counter (AC) 606, namely to a graphic RAM (GRAM) 610. Display operation is as follows. That is, a timing generation circuit 622 generates a timing and a display address required for the display operation based on the clock signal generated by an internal clock generation circuit (CPG) 630.

With this timing and display address, the display data is read from the graphic RAM (GRAM) 610 and are then transmitted to the liquid crystal panel through conversion into the voltage level which is necessary for liquid crystal display. Changing between the moving picture display mode and still picture display mode is performed by a display operation changing register (DM) 621 or a RAM access changing register (RM) 605.

In the moving picture display mode, moving picture display data (PD17-0), a vertical synchronization signal VSYNC, a horizontal synchronization signal HSYNC, a dot clock DOTCLK and a data enable signal ENABLE are inputted to an external display interface 620 from the application processor 42. The display operation changing register (DM) 621 changes the timing in the timing generation circuit 622 to the synchronization signals (VSYNC, HSYNC) from the built-in reference to generate the necessary timing signal. The timing generation circuit 622 includes the display address generation circuit illustrated in FIG. 3 but this circuit is eliminated to simplify the drawing.

Moreover, the RAM access changing register (RM) 605 changes operation of the write address counter (AC) 606 to a signal generated from the dot clock DOTCLK and data enable signal ENABLE and also changes a data bus to the graphic RAM (GRAM) 610 to the display data (PD17-0). Thereby, the display operation and RAM access operation can be changed to the external display interface module 620 as the moving picture interface from the system interface 601 and internal clock generation circuit (CPG) 630.

In FIG. 10, reference numeral 602 designates a gate driver interface (serial); 603, an index register (IR); 604, a control register (CR); 607, a bit operation circuit to execute arithmetic process in unit of bit; 608 is a read data latch circuit; 609, a write data latch circuit. Moreover, numerals 623, 624 and 626 are latch circuits; Numeral 625, N A/C circuit; 627, a source driver forming a liquid crystal drive circuit (a liquid crystal drive circuit) 64. Numeral 640 is a Gamma (γ) adjusting circuit; 650, a grayscale voltage generator forming a circuit to process the display data to the liquid crystal panel. The bit operation circuit 607 is provided to execute arithmetic operation in unit of bit and rearrangement process in unit bit. Therefore this circuit may be eliminated when this function is unnecessary.

Next, details of the changing register for the system interface and application interface will be explained. Table 1 illustrates a mode setting condition of the RAM access changing register (RM) 605 explained with reference to FIG. 10. In this Table 1, this register is referred to as a RAM access mode register.

TABLE 1

| RM | Interface for RAM access |
|---|---|
| 0 | System interface/VSYNC interface |
| 1 | RGB interface |

Moreover, the Table 2 illustrates a mode setting condition of the display operation changing register (DM) 605 explained with reference to FIG. 10. In the Table 2, this register is referred to as display operation mode register.

TABLE 2

| DM1 | DM0 | Interface for display operation |
|---|---|---|
| 0 | 0 | Internal clock operation |
| 0 | 1 | RGB interface |
| 1 | 0 | VSYNC interface |
| 1 | 1 | Setting inhibited |

The table 3 illustrates various display operation mode conditions through the combined setting of the RAM access changing register (RM) and the display operation changing register (DM).

TABLE 3

| Display condition | Operation mode | RAM access setting (RM) | Display operation mode (DM1-0) |
|---|---|---|---|
| Still picture display | Only internal clock operation | System interface (RM = 0) | Internal clock operation (DM1-0 = 00) |
| Moving picture display | RGB interface (1) | RGB interface (RM = 1) | RGB interface (DM1-0 = 01) |
| Rewriting of still picture area in the moving picture display | RGB interface (2) | System interface (RM = 0) | RGB interface (DM1-0 = 01) |
| Moving picture display | VSYNC interface | System interface (RM = 0) | VSYNC interface (DM1-0 = 10) |

As illustrated in the Table 1, the RAM access changing register (RN) set the changing of the interface for making access to the built-in display memory (graphic RAM) GRAM. Setting of the RAM access changing register (RM register) will be explained based on the "Setting Condition of RM". When "RM=0", the write operation of display data to the memory GRAM from only the system interface is possible. Moreover, when "RM=1", the write operation of display data to the memory GRAM only from the application interface (moving picture interface, RGB interface of Table 1) is possible.

The display operation changing register (DM register) illustrated in the Table 2 changes the display operation mode with the setting of 2 bits. The setting of this DM register will be explained based on the "Setting Condition of DM". When "DM=00", the display operation by the built-in clock is performed. Moreover, when "DM=01", the display operation is performed by the moving picture interface (RGB interface). Moreover, when "DM=10", the display operation is performed by the VSYNC interface and this display operation is performed only with the VSYNC signal in the RGB interface and with the built-in block. Setting of "DM=11" is inhibited.

As described above, change of interface is independently controlled with two registers of the RAM access change register and display operation change register (RAM register and DM register). As summarized in the Table 3, various operations in various display modes can be realized by changing the display operation in accordance with the setting conditions of a couple of registers. In the Table 3, the "setting conditions of DM" is expressed as (DM1-0=00).

Figure 11:
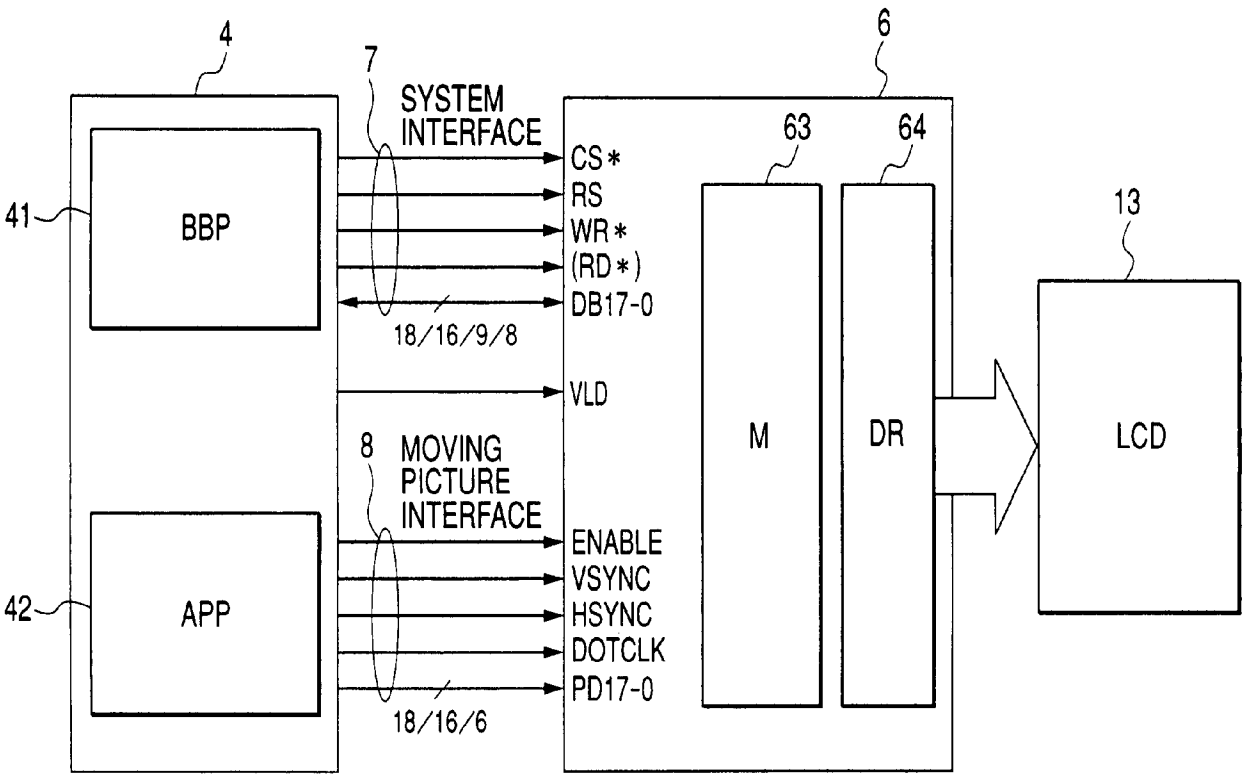
FIG. 11 is a diagram for describing a configuration of an embodiment of a liquid crystal controller driver which is provided with a system interface and an application interface to realize data transfer with a built-in memory and operations thereof.
Figure 12:
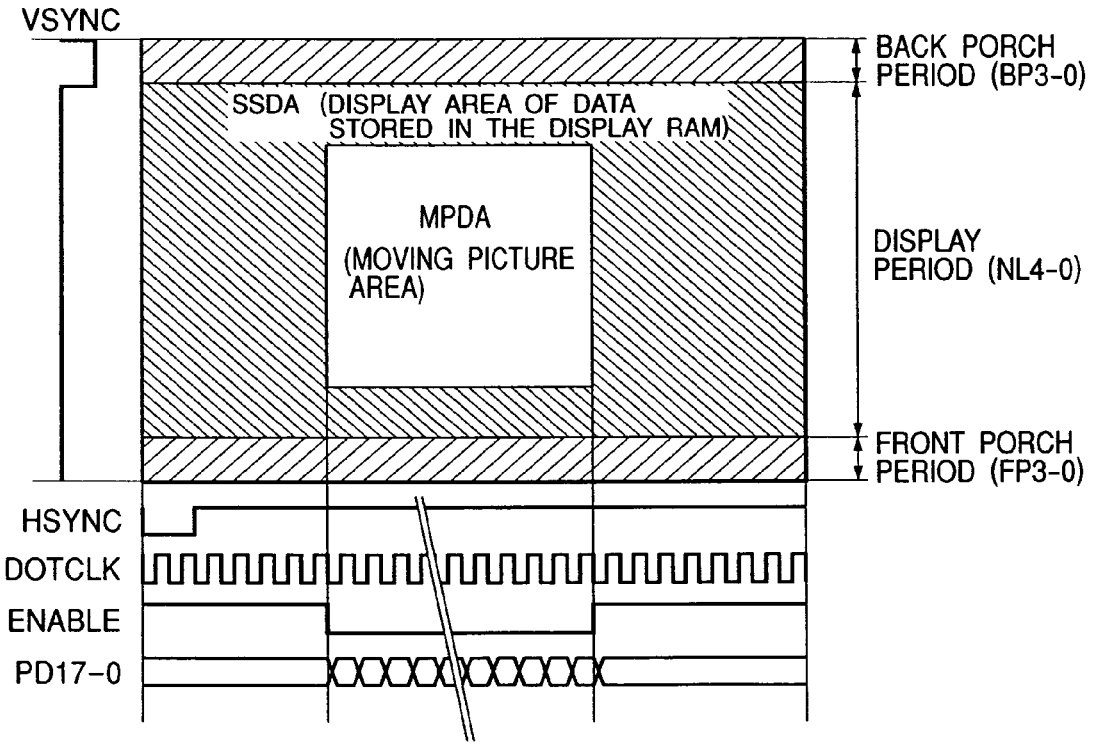
FIG. 12 is a schematic diagram for describing a profile of still picture display by the liquid crystal controller driver of FIG. 11.

FIG. 11 is a diagram for describing a configuration and operation thereof of the embodiment of the liquid crystal controller driver for data transfer with the built-in memory by providing the system interface and application interface. Moreover, FIG. 12 is a schematic diagram for describing a profile of still picture display with the liquid crystal controller driver of FIG. 11. In this embodiment, data of the system interface (baseband interface) 41 for inputting the still picture data or the like and the application interface 42 as the moving picture interface are stored in the built-in RAM memory (display memory M) 63 as the display memory.

The vertical synchronization signal VSYNC becomes a timing signal indicating the start of display screen for display operation, while the horizontal synchronization signal HSYNC becomes the timing signal indicating the line period of the display operation and the dot clock DOTCLK is the clock in unit of pixel and becomes the reference clock of the display operation by the moving picture interface, namely the application interface (APP) 42. Moreover, this dot clock DOTCLK also becomes the write signal of the display memory (M) 63. The application processor 42 transfers the picture data in synchronization with the dot clock DOTCLK. The enable signal ENABLE indicates that each pixel data is effective. Only when this enable signal ENABLE is effective, the transfer data is written into the display memory (M) 63.

Namely, as illustrated in FIG. 12, the moving picture display data PD17-0 is displayed in the moving picture display area MPDA in which the enable signal ENABLE in the RAM data display area (still picture display area) of the display screen is validated. At the upper and lower portions of the display screen, a back porch period (BP3-0) and front porch period (FP3-0) are provided and the display period (NL4-0) is provided between these periods.

Figure 13:
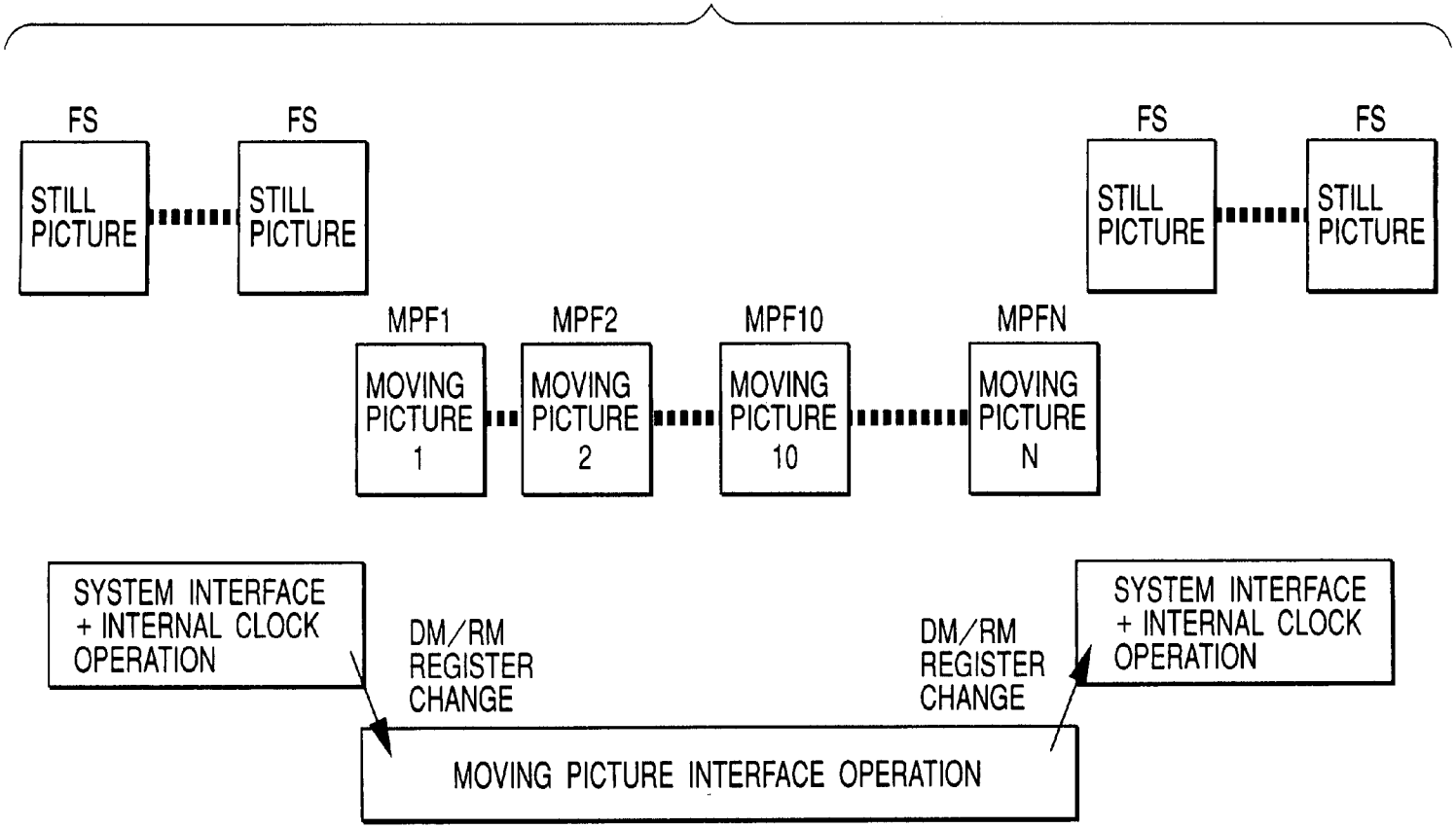
FIG. 13 is a diagram for describing a changing operation for the system interface and application interface in the condition of display picture.

FIG. 13 is a diagram for describing the change operation of the system interface and application interface in the condition of the display screen. A still picture FS is displayed with operation of the system interface, while the moving pictures MP1, MP2, . . . , MP10, . . . , MPN are displayed with operation of the application interface. In the mobile telephone, the period for display of moving picture must be considerably shorter than the total display period. Therefore, low power consumption can be realized with the "system interface+display with internal clock" during the still picture display period which occupies the greater part of display period.

Only for the moving picture display, the application interface (moving picture interface) is set effective by changing reach register (RM, DM) as described above. Accordingly, the operation period of the interface which uses the transfer power of data can be minimized to realize reduction in the total power consumption of system. The instruction setting of this system including the setting of register is enabled only from the system interface. However, setting of instruction from the other route is also possible.

Figure 14:
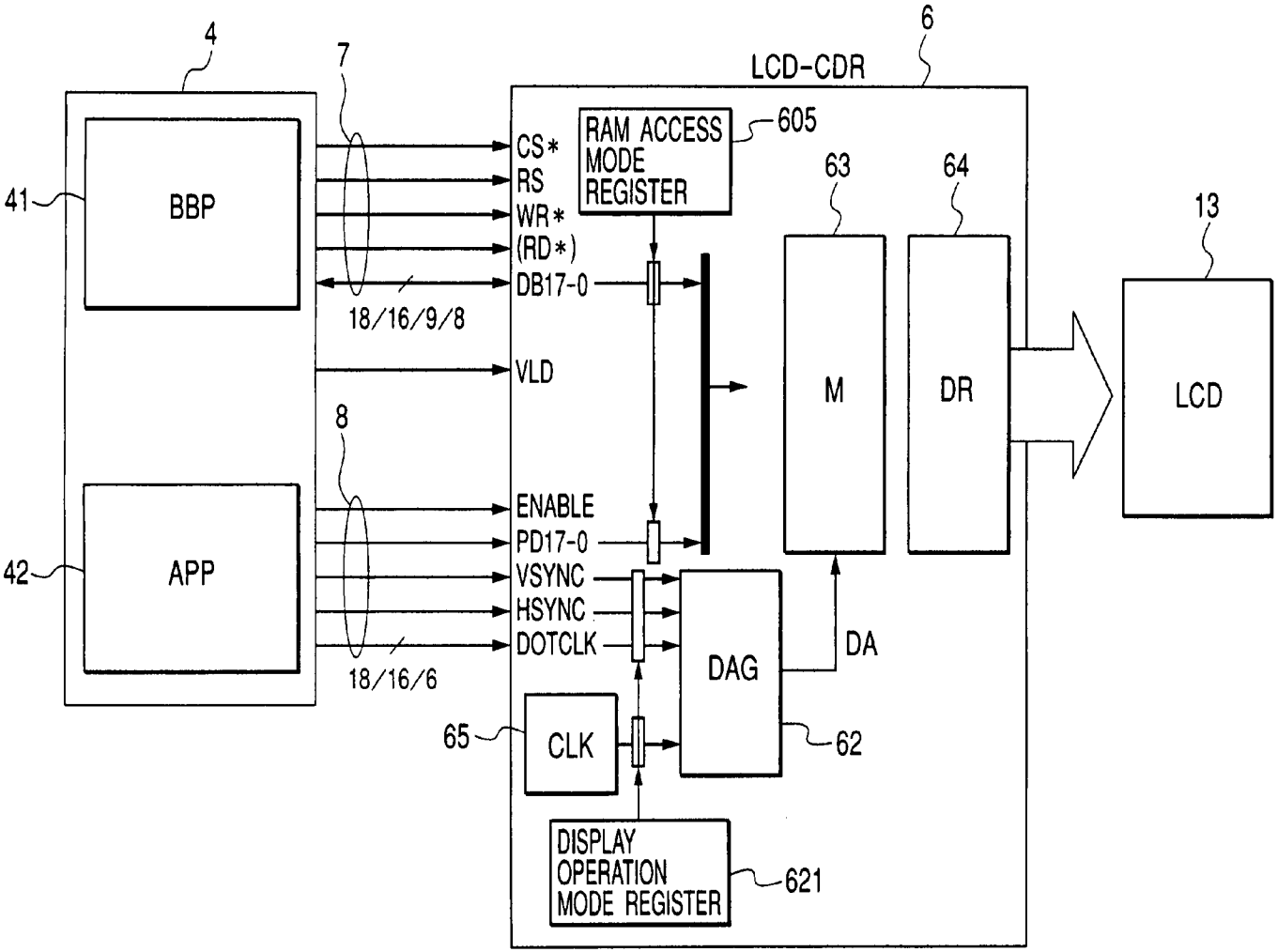
FIG. 14 is a diagram for describing the other embodiment of the present invention.

FIG. 14 is a diagram for describing the other embodiment of the present invention and is a block diagram for describing a circuit configuration to execute the moving picture buffering operation. In the moving picture display system described with reference to FIG. 5 and FIG. 6, display is performed by sequentially storing the display data in the line memory during the moving picture display (when the application interface is used). Therefore, the display data has to be always transferred continuously. In this embodiment, even when the moving picture interface (application interface (APP) 42) is used, the display data is all stored in the RAM memory (M) 63, the stored display data is read, outputted and then displayed to the liquid crystal panel depending on the synchronization signals (VSYNC, HSYNC, DOTCLK, ENABLE) to be inputted by the moving picture interface (63). Access to the built-in RAM memory (M) 63 is changed with the access mode register (RM register) 605.

Figure 15:
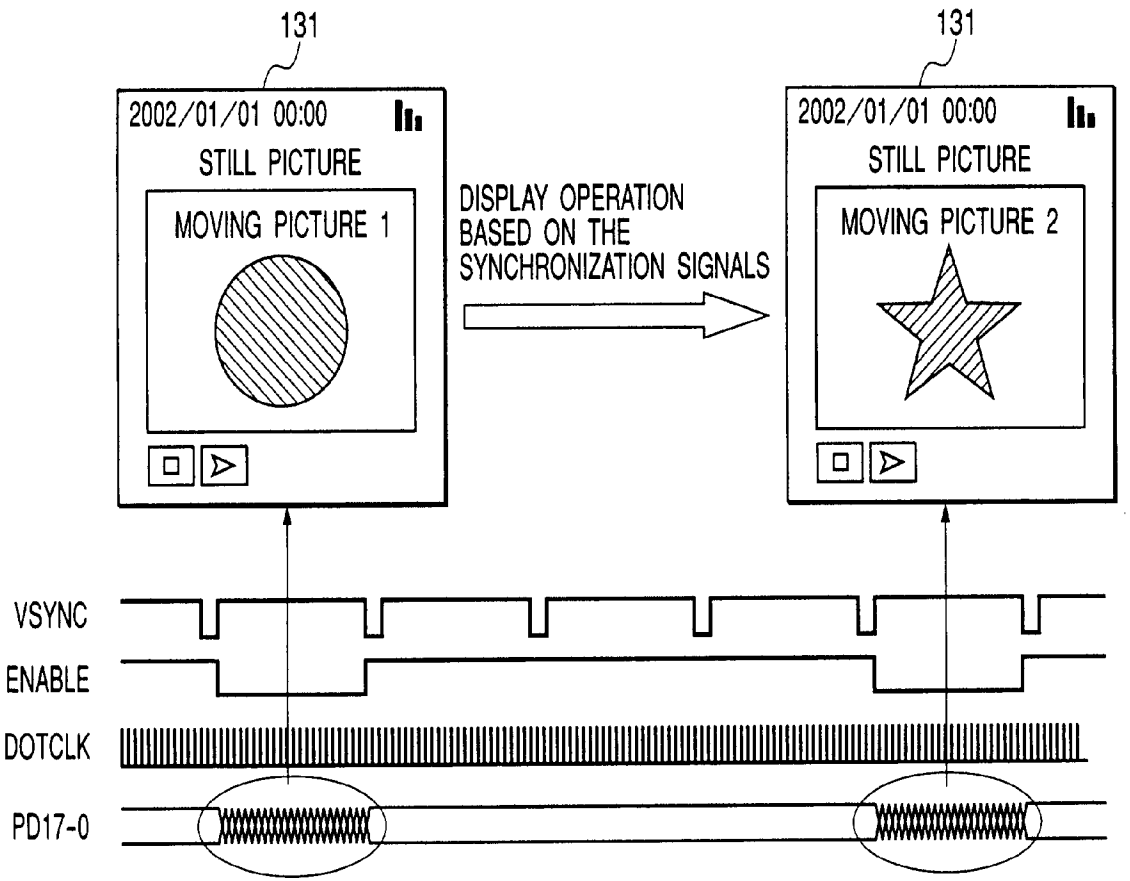
FIG. 15 is a schematic diagram for describing a profile of the transfer of moving picture data in the moving picture buffering operation by a circuit configuration of FIG. 14.

FIG. 15 is a schematic diagram for describing a profile of moving picture data transfer in the moving picture buffering operation by the circuit configuration of FIG. 14.

In the moving picture display in which only the line memory described in FIG. 5 is used, moving picture data must always be transferred. In the present mobile telephone system, the number of frames per second during the moving picture display period is 10 to 15. Therefore, when the number of display frames per second is defined as 60, the change of display screen is performed in every four frames. Namely, the same picture is displayed during the period of four frames.

When a moving picture in the present mobile telephone system has a format described in FIG. 5 and FIG. 6, power consumption by data transfer increases because data transfer must be performed for the same picture data display period of four frames. In this embodiment, since the moving picture buffering is executed for storing all of the moving picture data to the built-in RAM memory, data transfer is performed only during the change of display screen and thereby the display data of the built-in memory can be changed. Thereafter, during the display period of the same display picture, the display data stored in the memory is read and displayed without execution of data transfer from the system side. Accordingly, the number of times of data transfer of moving picture data is reduced ¼ in comparison with the related art under the condition that the number of frames of moving picture per second is 15 and the frame frequency is 60 Hz.

Figure 16:
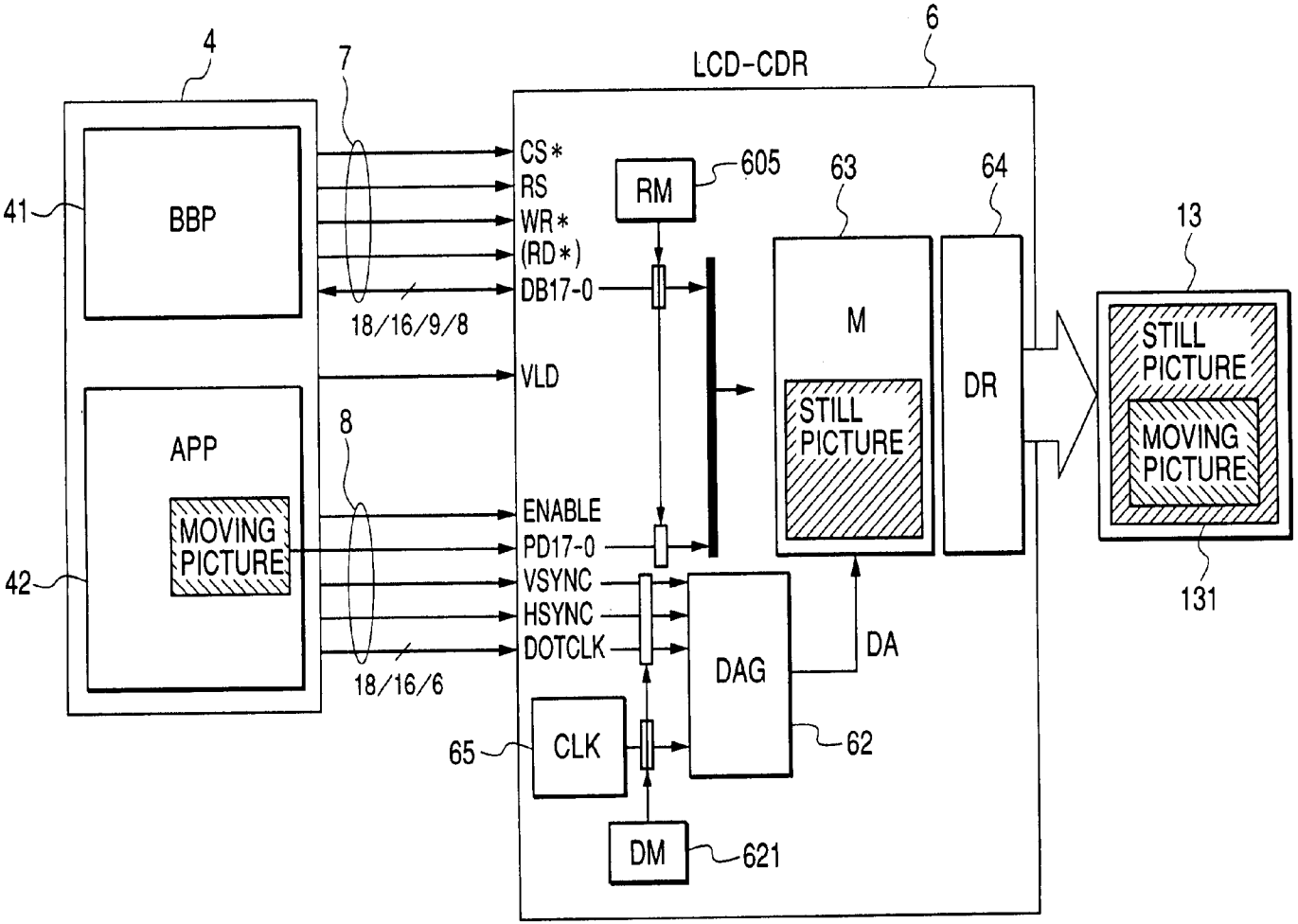
FIG. 16 is a block diagram for describing an embodiment of a circuit configuration to realize the transfer of moving picture in the present invention.
Figure 17:
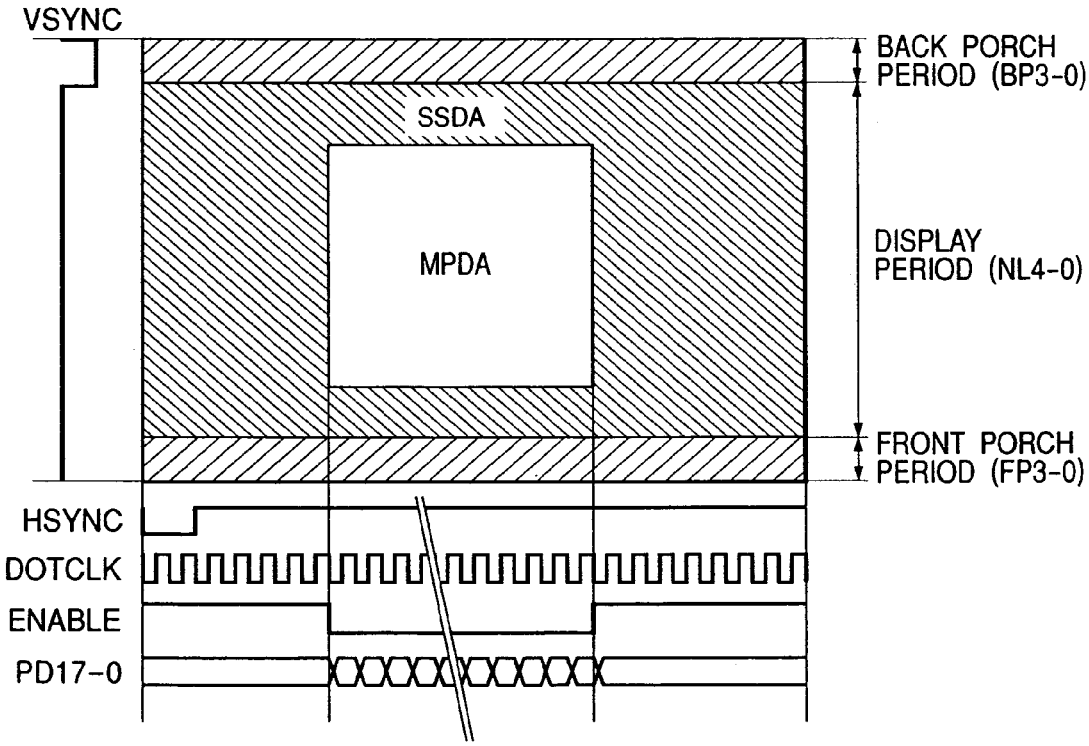
FIG. 17 is a schematic diagram for describing a profile of still picture display only to the selected area by the liquid crystal controller driver of FIG. 16.

In the present invention, it is also possible that the relevant moving picture data is transferred only to the selected area of the moving picture data display area in the case where the moving picture data display area MPDA is inserted to the RAM data display area (still picture display area) SSDA of the display screen described above. FIG. 16 is a block diagram for describing an embodiment of the circuit configuration to realize transfer of moving picture data by the present invention. Moreover, FIG. 17 is a schematic diagram for describing a profile of the still picture display only to the selected area by the liquid crystal controller driver of FIG. 16.

In the case where the moving picture buffering is not performed, the display data must have always been transferred from the moving picture interface including the still picture display area SSDA other than the moving picture display area MPDA during the moving picture display using a part of the liquid crystal panel. Therefore, the number of times of data transfer increases, also resulting in increase of power consumption. In the selected area transfer system of this embodiment, only the display data of the moving picture display area MPDA can be transferred from the moving picture interface.

In the selected area transfer system, still picture data is previously written into the display memory and the display data is written from the moving picture interface only to the display memory designated with the enable signal ENABLE. Accordingly, the still picture and moving picture are combined on the display memory and are then read simultaneously at the time of display operation and are then displayed on the liquid crystal panel 13. According to the present invention, as described above, the moving picture display area can be selectively designated, the moving picture can be displayed with the minimum data transfer corresponding to the moving picture area and thereby power consumption during the data transfer can be reduced. Above process is never limited only to a display device of mobile telephone and can also be applied to a large-size display device such as a personal computer and a display monitor or the like.

Figure 18:
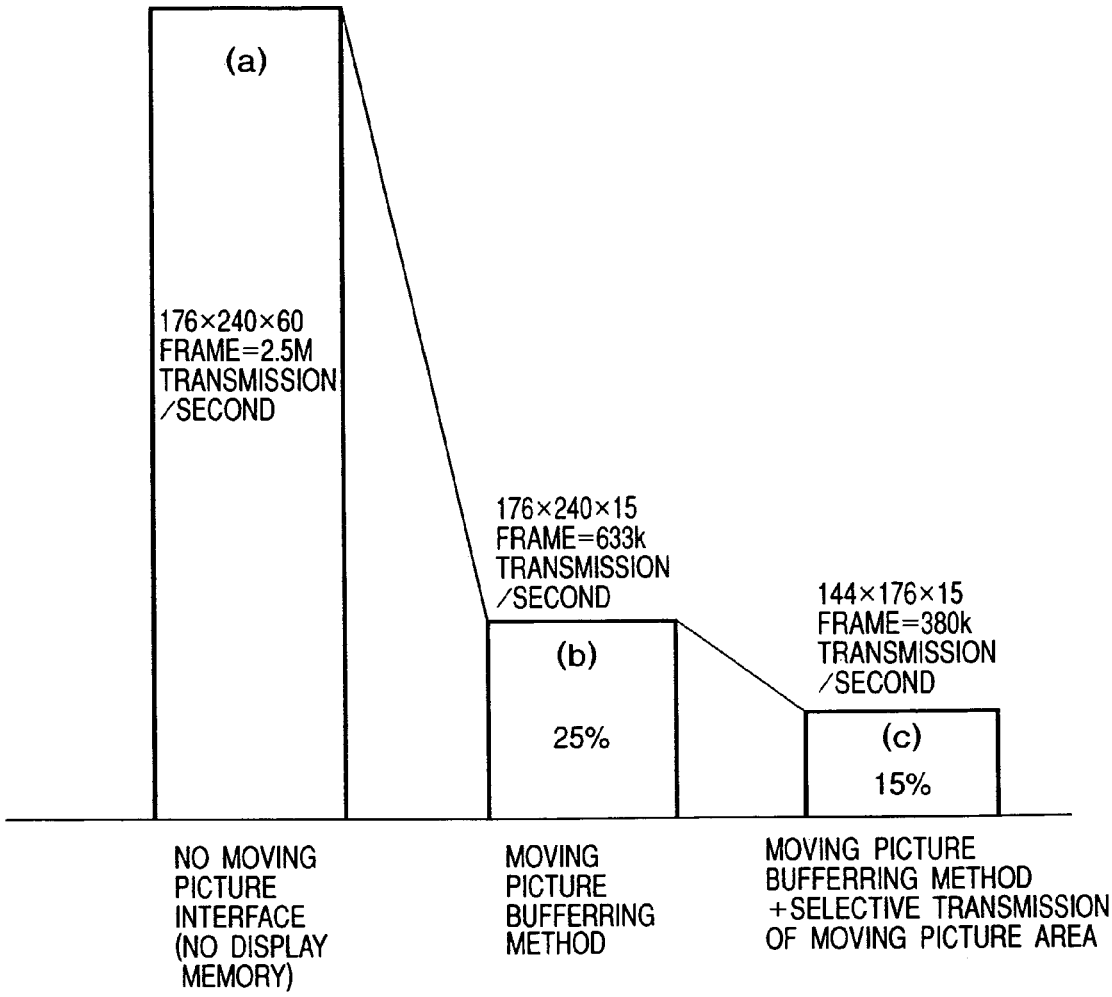
FIG. 18 is a diagram for describing comparison for the number of times of moving picture data transfers in each data transfer system for describing effects of the present invention.

FIG. 18 is a diagram for comparison of the number of times of moving picture data transfer in each data transfer system for describing the effect of the present invention. FIG. 18 illustrates the results of comparison by the liquid crystal display device under the conditions that the liquid crystal panel size is 176×240 dots, moving picture size is QCIF size (144×176 dots), number of moving picture frames is 15/sec (fps) and the frame frequency is 60 Hz. As can be understood from FIG. 18, the results are (a) 176×240×60 frames=2.5 M transfers/sec only for the moving picture interface (without built-in memory), (b) 176×240×15 frames=633 K transfers/sec for the moving picture buffering system and (c) 144×176×15 frames=380 K transfers/sec for the moving picture buffering system+selected moving picture area transfer system.

Therefore, the amount of data transfer in the (b) moving picture buffering system is reduced by about 25% in comparison with the (a) moving picture interface, while the amount of data transfer in the (c) moving picture buffering system+selected moving picture area transfer system is reduced by about 15% in comparison with the (a) moving picture interface.

Figure 19:
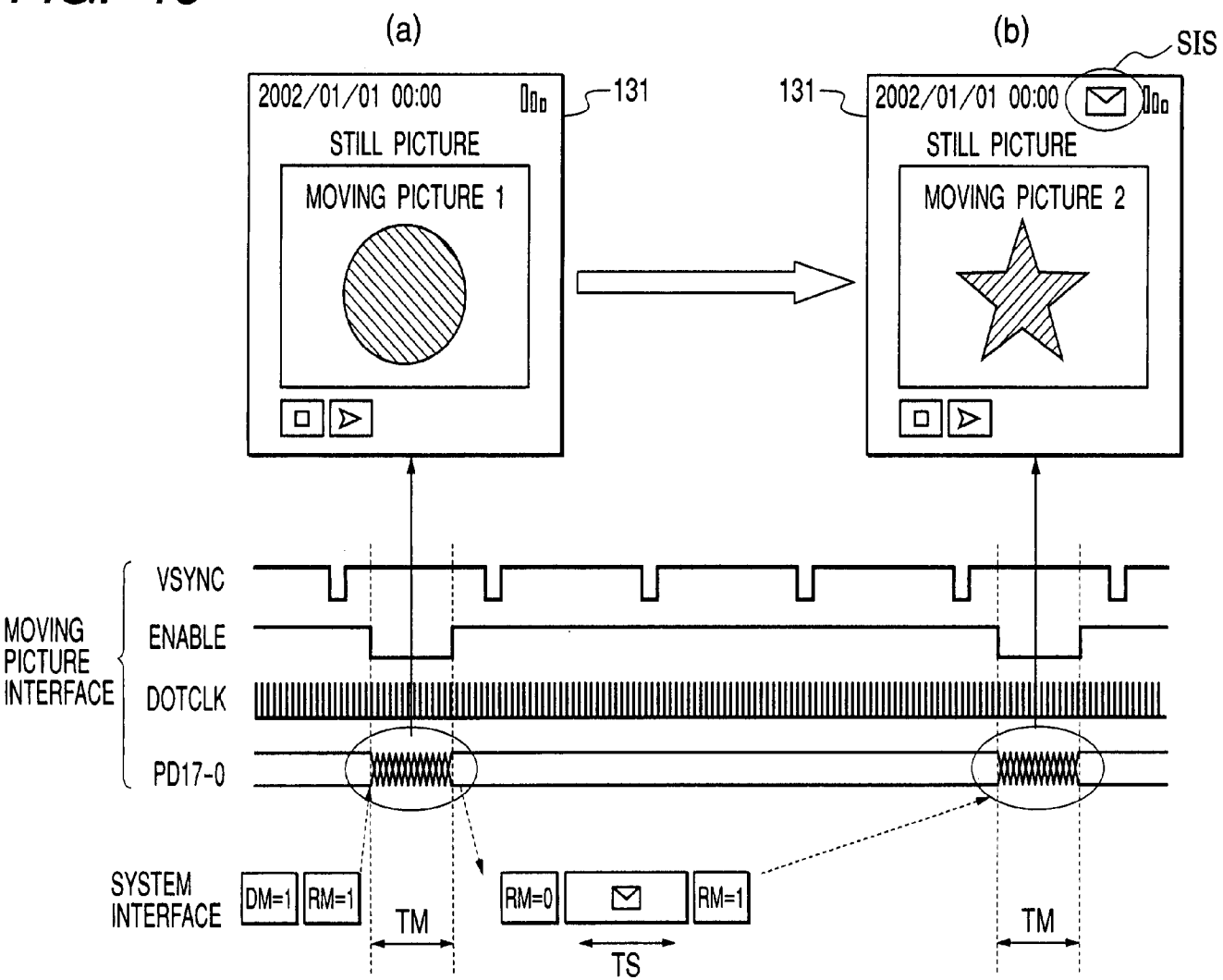
FIG. 19 is a diagram for describing the other embodiment of the present invention.

FIG. 19 is a diagram for describing another embodiment of the present invention and is a schematic diagram for describing a system for changing display in the still picture display area during the display of moving picture. As has been described practically with reference to FIG. 10, in the liquid crystal controller driver of the present invention, a register changes the still picture interface and the moving picture interface and the moving picture buffering as described with reference to FIG. 14 is possible. Accordingly, display in the still picture area can also be changed during the display of moving picture.

As illustrated in FIG. 19, even when a moving picture is being displayed on the display screen, it is required to change the icon marks (clock, radio wave condition) used for the mobile telephone. Here, an example is considered where a mail termination display SIS is displayed in the still picture display area on the display screen. Change of display data based on the moving picture buffering system is performed at the time of changing the display picture. During the other periods, only the display operation is performed. As described previously, the still picture display mode and moving picture display mode are changed by a register (display operation change register (DM), RAM access change register (RM)). Moreover, this change is performed independently and respectively from display operation and access to memory.

Therefore, in this embodiment, as illustrated in the operation waveforms of FIG. 19, only the RAM access is changed to the system interface in order to change of display data in the still picture display area by setting the RAM access change register (RM) to "=0" during the period other than the change of display picture during the moving picture display. When the change period TS of this still picture display area is terminated, the relevant RAM access change register (RM) is set to "=1". During the change period TS of this still picture display area, the display operation change register (DM) is set to "=1" and display is lasted from the moving picture interface. Thereby, change of the still picture display area becomes possible even during the moving picture display to realize more flexible display profiles.

Figure 20:
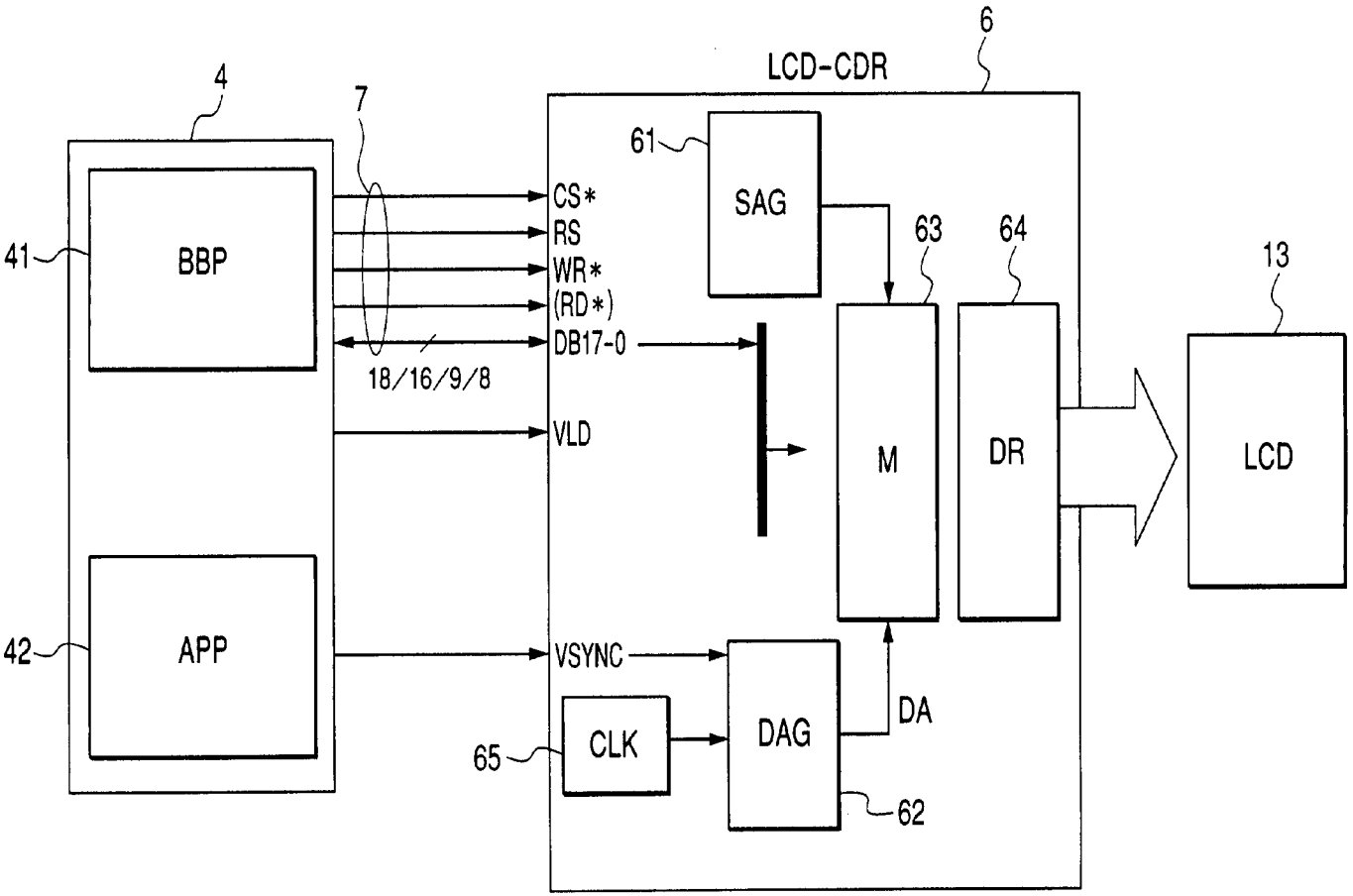
FIG. 20 is a diagram for describing still further embodiments of the present invention.

FIG. 20 is a diagram for describing another embodiment of the present invention and is a block diagram for describing configuration examples of the liquid crystal controller driver and peripheral circuits thereof when the VSYNC interface of the Table 2 and Table 3 is employed. A write address generation circuit (SAG) for controlling the write operation of memory (M) controls, from the system interface, the address generation timing of the display address generation circuit (DAG) for controlling the read operation of the memory (M) with the vertical synchronization signal VSYNC from the application processor 42. In this case, the display address generation circuit (DAG) includes a counter which is reset with the active level of the vertical synchronization signal VSYNC to count up the clock signal generated from the built-in clock circuit CLK and an output of this counter is used as the display address DA. In the case of this configuration, moving picture data can be displayed without almost any modification of the existing system. The write operation speed of moving picture data from the system interface side must be performed sufficiently faster than the display operation based on the clock signal from the built-in clock generation circuit. Other configurations and operations are identical to that described with reference to FIG. 3.

In the configuration of this embodiment, picture display may be synchronized with the scanning timing on the screen by controlling the written display data read start point with the vertical synchronization signal VSYNC from the application processor 42 for the display memory (M) and thereby the display picture is never changed in the course of display screen. Accordingly, no flicker is generated on the display screen during the change of display picture.

The present invention has been described based on the embodiments thereof but the present invention is not limited to the configurations of above embodiment and allows, of course, various modifications within the scope of technical concepts thereof.

As described above, according to the present invention, since the display picture is changed during the moving picture period in synchronization with frames, no flicker is displayed on the display screen during the change of picture displayed. Moreover, since the number of transfer data of display data during the moving picture display can be reduced, a total power consumption of system using the display drive control circuit of the present invention can also be reduced.

In addition, since the system is configured to independently control the change between the still-picture•text•system•I/O•interface and external display interface for inputting the moving picture data from the picture data processor and the access to the picture display memory, the display mode can be selected in accordance with the display contents.

Moreover, respective interface functions can be used effectively by changing the corresponding interface in the moving picture display mode and still picture display mode and the total power consumption of system can also be reduced.

What is claimed is:

1. A method for changing icon marks when a moving picture is being displayed on a display panel of a display system, wherein the display system comprises a display control device coupled to the display panel, and a processor coupled to the display control device, wherein a moving picture is displayed on a first portion of the display panel, and the icon marks are displayed on a second portion on the display panel, wherein the display control device includes a display memory, a first register, and a second register, wherein the first register is configured to set a first state in which the display memory is enabled to write icon mark data provided from the processor to the display control device, and to set a second state in which the display memory is enabled to write moving picture data provided from the processor to the display control device, and wherein the icon mark data is previously written into the display memory, and the moving picture data written into a selected area of the display panel when the first register is in the second state and the second register is in a first enable state, the method comprising:

1) setting the first register to the second state by the processor and writing the moving picture data into the display memory when the second register is in the first enable state;

2) setting the second register to a second enable state by the processor and writing the icon mark data into the display memory; and 3) setting the register back to first enable state by the processor.

2. The method according to claim 1, wherein the display system is a mobile phone.

3. The method according to claim 1, wherein processor includes a base band processor which provides the icon mark data and an application processor which provides the moving picture data.

4. The method according to claim 3, wherein the base band processor and the application processor are on one semiconductor substrate.

5. The method according to claim 3, wherein each of the base band processor and the application processor is on a respective semiconductor substrate.

6. A method comprising:

displaying a moving picture on a first portion of a display panel of a display system using a display control device coupled to the display panel, the display control device also being coupled to a processor;

displaying a still picture on a second portion of the display panel using the display control device;

enabling a display memory of the display control device to write still picture data provided by the processor to the display control device when a first register of the display control device is set to a first state;

enabling the display memory of the display control device to write moving picture data provided by the processor to the display control device when the first register of the display control device is set to a second state;

writing moving picture data into a selected area of the display panel when the first register is in a first enable state and a second register of the display control device is in a second enable state, still picture data having been previously written into the display memory; and changing the displayed still picture while the moving picture is being displayed on the display panel of the display system by setting the first register to the second state by the processor and writing moving picture data into the display memory when the second register is in the first enable state;

setting the second register to the second enable state by the processor and writing still picture data into the display memory; and setting the second register back to the first enable state by the processor.

7. The method according to claim 6, wherein the display system is a mobile phone.

8. The method according to claim 6, wherein processor includes a base band processor which provides the still picture data and an application processor which provides the moving picture data.

9. The method according to claim 8, wherein the base band processor and the application processor are on one semiconductor substrate.

10. The method according to claim 8, wherein each of the base band processor and the application processor is on a respective semiconductor substrate.

* * * * *